US009861146B2

(12) United States Patent
Martel et al.

(10) Patent No.: US 9,861,146 B2
(45) Date of Patent: Jan. 9, 2018

(54) PANTS ASSEMBLY

(71) Applicants: Pascal Martel, Montreal (CA); Christian Gervais, Montreal (CA); Marc Gagnon, Verdun (CA)

(72) Inventors: Pascal Martel, Montreal (CA); Christian Gervais, Montreal (CA); Marc Gagnon, Verdun (CA)

(73) Assignee: BAUER HOCKEY, LLC, Exeter, NH (US)

( * ) Notice: Subject to any disclaimer, the term of this patent is extended or adjusted under 35 U.S.C. 154(b) by 13 days.

(21) Appl. No.: 14/978,737

(22) Filed: Dec. 22, 2015

(65) Prior Publication Data

US 2016/0174627 A1 Jun. 23, 2016

(30) Foreign Application Priority Data

Dec. 23, 2014 (CA) ..... 2876433

(51) Int. Cl.

| | |
|---|---|
| ***A41F 9/00*** | (2006.01) |
| ***A41D 13/015*** | (2006.01) |
| ***A41D 1/08*** | (2006.01) |
| ***A41D 13/00*** | (2006.01) |

(52) U.S. Cl.

CPC ..... *A41F 9/002* (2013.01); *A41D 1/088* (2013.01); *A41D 13/0015* (2013.01); *A41D 13/0153* (2013.01); *A41D 2600/10* (2013.01)

(58) Field of Classification Search

CPC ..... A41F 9/002; A41F 7/00; A41D 1/088; A41D 1/08; A41D 2600/10; A41D 13/0153; A41D 13/0015; A41D 13/00

USPC ..... 2/235, 69, 227, 76, 236–238, 229, 400, 2/81

See application file for complete search history.

(56) References Cited

U.S. PATENT DOCUMENTS

| | | | | | |
|---|---|---|---|---|---|
| 156,170 | A | * | 10/1874 | Loewenstein | A41D 1/06 2/235 |
| 849,060 | A | * | 4/1907 | Fredbaum | A41F 9/00 2/235 |
| 888,063 | A | * | 5/1908 | Brooks | A41F 9/002 2/312 |
| 1,072,776 | A | * | 9/1913 | Routery | A41D 15/00 2/70 |
| 1,107,158 | A | * | 8/1914 | Day | A41F 9/00 2/236 |

(Continued)

FOREIGN PATENT DOCUMENTS

| | | |
|---|---|---|
| CA | 2464782 | 10/2005 |

OTHER PUBLICATIONS

Bauer 2011 Product Catalog, Bauer Supreme Totalone pants, 3 pages.

(Continued)

*Primary Examiner* — Shaun R Hurley
*Assistant Examiner* — Bao-Thieu L Nguyen

(57) ABSTRACT

The invention relates generally to a pants assembly comprising an outer shell, inner pants, and a retaining system with first and second retainers mounted to the inner pants and outer shell and a belt at least partially encircling the inner pants and being at least partially on an outer side of the outer shell for allowing fit adjustment of the inner pants and outer shell around the wearer's waist. The inner pants and outer shell are coupled together by the belt while the outer shell is movable relative to the inner pants.

44 Claims, 24 Drawing Sheets

(56) References Cited

U.S. PATENT DOCUMENTS 1,614,965 A * 1/1927 Margolith ..... A41F 9/00 2/236
1,998,085 A * 4/1935 Jones ..... A41B 13/00 2/78.2
2,242,365 A * 5/1941 Muhr ..... A41D 15/00 2/70
2,663,027 A * 12/1953 Posson ..... A41F 9/025 2/237
2,977,601 A * 4/1961 Winston ..... A41F 9/025 2/221
3,007,173 A * 11/1961 Gongoll ..... A61F 9/029 2/446
3,484,868 A * 12/1969 Davenport, Jr. ..... A63B 71/12 2/23
3,574,237 A * 4/1971 Reynolds ..... A41D 15/005 2/211
4,188,672 A * 2/1980 Kalso ..... A41F 9/025 128/96.1
4,325,148 A 4/1982 Livernois
4,561,121 A * 12/1985 Ehring ..... A41D 13/00 2/227
4,811,427 A 3/1989 Regan
5,036,548 A * 8/1991 Grilliot ..... A62B 17/003 182/3
5,123,120 A * 6/1992 Ross ..... A41D 13/02 2/229
5,136,724 A * 8/1992 Grilliot ..... A62B 35/0025 182/3
5,289,590 A * 3/1994 Larson ..... A41D 13/0007 2/227
5,539,927 A 7/1996 Holubec
5,819,320 A * 10/1998 Jolla ..... A41F 9/00 2/227
5,926,856 A * 7/1999 Duval ..... A41D 13/0153 2/22
6,105,169 A * 8/2000 Colorado ..... A41D 13/0007 182/6
6,205,591 B1 * 3/2001 Wheeler ..... A41B 9/08 2/227
6,317,893 B1 * 11/2001 Walton ..... A41D 13/012 2/227
6,327,715 B1 * 12/2001 Castiglione ..... A41D 1/082 2/227
6,490,733 B1 * 12/2002 Casaubon ..... A41D 13/0007 2/79
6,637,036 B2 * 10/2003 Beland ..... A41D 1/08 2/227
6,665,882 B1 * 12/2003 Pedrick ..... A41D 7/005 2/228
6,698,031 B2 * 3/2004 Lewis ..... A41D 13/00 2/340
6,701,533 B2 * 3/2004 Webb ..... A41F 11/02 2/228
6,782,559 B2 8/2004 Regan
6,789,270 B1 * 9/2004 Pedrick ..... A41D 7/005 2/228
6,804,832 B2 * 10/2004 Beland ..... A41D 1/08 2/227
6,990,687 B2 * 1/2006 Snedeker ..... A41D 1/06 2/79
7,047,567 B2 * 5/2006 Allen ..... A41D 13/0007 2/69
7,574,752 B1 * 8/2009 Walters ..... A41D 1/062 2/227
7,596,816 B1 * 10/2009 Henry ..... A41D 1/062 2/227
7,694,349 B2 * 4/2010 Skottheim ..... A41D 13/015 2/212
7,836,519 B2 * 11/2010 Zahler ..... A41D 1/02 2/69
7,937,767 B2 * 5/2011 Leach ..... A41B 11/12 2/22
8,074,298 B2 * 12/2011 Davenport ..... A41B 9/001 2/227
8,104,100 B2 * 1/2012 Razzaghi ..... A41F 3/00 2/327
8,146,170 B2 * 4/2012 Goodhand ..... A41D 13/0015 2/22
8,161,573 B1 * 4/2012 Burns-Cox ..... A41D 13/1245 2/227
8,316,468 B2 * 11/2012 Skottheim ..... A41D 1/08 2/227
8,667,615 B2 * 3/2014 Vanderburgh ..... A41D 1/06 2/227
8,782,813 B2 * 7/2014 Usami ..... A41D 3/00 2/108
8,813,266 B1 * 8/2014 Green ..... A41F 7/00 2/229
8,966,667 B2 * 3/2015 Peck ..... A41D 1/08 2/227
9,015,867 B2 * 4/2015 Kenney ..... A41D 15/02 2/227
9,101,789 B2 * 8/2015 Schierenbeck .... A62B 35/0012
2004/0163159 A1 * 8/2004 Edwards ..... A41F 9/02 2/338
2005/0223462 A1 * 10/2005 Snedeker ..... A41D 1/06 2/69
2005/0246820 A1 * 11/2005 Davenport ..... A41B 9/001 2/227
2006/0282938 A1 12/2006 Jewell et al.
2007/0000012 A1 * 1/2007 Davenport ..... A41B 9/001 2/69
2007/0101474 A1 * 5/2007 Skottheim ..... A41D 1/08 2/69
2007/0234467 A1 * 10/2007 Leach ..... A41B 11/12 2/227
2010/0199402 A1 * 8/2010 Curtis ..... A47G 9/066 2/69
2011/0179556 A1 * 7/2011 Partovi ..... A41F 7/00 2/406
2012/0096627 A1 * 4/2012 Gosse ..... A41D 1/082 2/227
2013/0212772 A1 * 8/2013 Apostoloff ..... A41D 3/00 2/93
2013/0291277 A1 * 11/2013 Kirkwood ..... A41D 1/22 2/69
2014/0304882 A1 * 10/2014 Lloyd ..... A41F 9/00 2/69
2014/0317832 A1 * 10/2014 Allen ..... A41D 1/06 2/236
2016/0174623 A1 * 6/2016 Lavallee ..... A41D 13/0153 2/466

OTHER PUBLICATIONS

CCM-Reebok Hockey Catalog 2011, Reebok 9k Pants, 2 pages.
Reebok Hockey Catalog 2011, Reebok 11k Pants, 2 pages.

* cited by examiner

PANTS ASSEMBLY

FIELD OF THE INVENTION

The invention relates generally to a pants assembly and, in particular, to a pants assembly for use in sports.

BACKGROUND

Traditionally, protective pants assemblies such as hockey pants assemblies, which are knee-to-waist protective gear for hockey players, have been formed as an oversized pair of shorts and constructed as a single piece of equipment including several protective elements and padding.

Recently, manufacturers have taken new approaches for hockey pants. More specifically, upon recognizing the expense of such pants, and recognizing that players often play for more than one team which may have different team colors, two-piece hockey pants have been developed in which an inner pant is coupled with a removable outer shell. Thus, a player can purchase multiple outer shells in different colors to use with a single inner pant. Additionally, as most of the wear and tear of hockey pants is focused on the outer shell, replacement of only the outer shell instead of the entire pants further reduces expense.

The manner in which the inner pant is mounted to the outer shell can affect the player's mobility. For example, the player's mobility may be adversely affected by the interaction between the inner pant and the outer shell. A retaining system for coupling the inner pant to the outer shell should ideally be unobtrusive to minimize player discomfort and maximize the player's range of motion. Additionally, the retaining system should withstand impacts as they are common in hockey.

Accordingly, there is a need in the art for an improved pants assembly that offers versatility, while offering proper protection and minimizing restriction of movement.

SUMMARY OF THE INVENTION

According to a broad aspect, the invention provides a pants assembly for a wearer having a lower spine region, lower ribs, a waist, a pelvic region with left and right hips, a crotch region, a genital area, and left and right thighs, the pants assembly comprising: (a) inner pants comprising a waist portion for covering the wearer's waist, a pelvic portion with front and rear panels for covering the wearer's pelvic region, a crotch portion for covering the wearer's crotch region and left and right leg portions for covering at least partially the left and right thighs of the wearer, the inner pants having inner and outer sides and a waist portion; (b) an outer shell at least partially covering the inner pants, the outer shell having left and right leg sections covering the left and right leg portions of the inner pants, the outer shell having inner and outer sides and a waist portion; (c) a belt having a first portion outside the outer shell and adjacent the outer side of the outer shell and a second portion inside the outer shell and adjacent the inner side of the outer shell and the outer side of the inner pants such that the belt at least partially encircles the waist portions of the inner pants and outer shell for allowing fit adjustment of the inner pants and outer shell around the wearer's waist; and (d) a first retainer mounted to the outer side of the inner pants and a second retainer mounted to the inner side of the outer shell, wherein the belt is received in the first and second retainers such that the inner pants and outer shell are coupled together and wherein one of the first and second retainers is slidable along the belt for allowing movement of the outer shell relative to the inner pants.

According to another broad aspect, the invention provides a pants assembly for a wearer having a lower spine region, lower ribs, a waist, a pelvic region with left and right hips, a crotch region, a genital area, and left and right thighs, the pants assembly comprising: (a) inner pants comprising a waist portion for covering the wearer's waist, a pelvic portion with front and rear panels for covering the wearer's pelvic region, a crotch portion for covering the wearer's crotch region and left and right leg portions for covering at least partially the left and right thighs of the wearer, the inner pants having inner and outer sides and a waist portion; (b) an outer shell at least partially covering the inner pants, the outer shell having left and right leg sections covering the left and right leg portions of the inner pants, the outer shell having inner and outer sides and a waist portion; (c) a belt having a first portion outside the outer shell and adjacent the outer side of the outer shell and a second portion inside the outer shell and adjacent the inner side of the outer shell and the outer side of the inner pants such that the belt at least partially encircles the waist portions of the inner pants and outer shell for allowing fit adjustment of the inner pants and outer shell around the wearer's waist; and (d) a left first retainer mounted to a left portion of the outer side of the inner pants at the waist portion, a right first retainer mounted to a right portion of the outer side of the inner pants at the waist portion, a left second retainer mounted to a left portion of the inner side of the outer shell at the waist portion, and a right second retainer mounted to a right portion of the inner side of the outer shell at the waist portion, wherein the belt is received in the left and right first retainers and left and right second retainers such that the inner pants and outer shell are coupled together, wherein the left and right first retainers or the left and right second retainers are slidable along the belt for allowing movement of the outer shell relative to the inner pants, and wherein the belt is removably received in the left and right first retainers or in the left and right second retainers such that the outer shell is removable from the inner pants.

According to a further broad aspect, the invention provides a pants assembly for a wearer having a lower spine region, lower ribs, a waist, a pelvic region with left and right hips, a crotch region, a genital area, and left and right thighs, the pants assembly comprising: (a) inner pants comprising a waist portion for covering the wearer's waist, a pelvic portion with front and rear panels for covering the wearer's pelvic region, a crotch portion for covering the wearer's crotch region and left and right leg portions for covering at least partially the left and right thighs of the wearer, the inner pants having inner and outer sides and a waist portion; (b) an outer shell at least partially covering the inner pants, the outer shell having left and right leg sections covering the left and right leg portions of the inner pants, the outer shell having inner and outer sides and a waist portion; (c) a belt having a first portion outside the outer shell and adjacent the outer side of the outer shell and a second portion inside the outer shell and adjacent the inner side of the outer shell and the outer side of the inner pants such that the belt at least partially encircles the waist portions of the inner pants and outer shell for allowing fit adjustment of the inner pants and outer shell around the wearer's waist; and (d) a front left first retainer mounted to a front left portion of the outer side of the inner pants at the waist portion, a front right first retainer mounted to a front right portion of the outer side of the inner pants at the waist portion, a rear left first retainer mounted to a rear left portion of the outer side of the inner pants at the waist portion, a rear right first retainer mounted to a rear right portion of the outer side of the inner pants at the waist portion, a left second retainer mounted to a left portion of the inner side of the outer shell at the waist portion, and a right second retainer mounted to a right portion of the inner side of the outer shell at the waist portion, wherein the belt is received in the front left and right first retainers, rear left and right first retainers, and left and right second retainers such that the inner pants and outer shell are coupled together and wherein the front left and right first retainers and rear left and right first retainers or the left and right second retainers are slidable along the belt for allowing movement of the outer shell relative to the inner pants.

According to a further broad aspect, the invention provides a pants assembly for a wearer, the pants assembly comprising: (a) inner pants comprising a waist portion for covering a waist of the wearer, a pelvic portion with front and rear panels for covering a pelvic region of the wearer, a crotch portion for covering the a crotch region of the wearer and left and right leg portions for covering at least partially left and right thighs of the wearer; (b) an outer shell at least partially covering the inner pants, the outer shell having left and right leg sections at least partially covering the left and right leg portions of the inner pants; and (c) a retainer mounted to one of (i) the inner pants and (ii) the outer shell, wherein the retainer supports a portion of the other one of (i) the inner pants and (ii) the outer shell in different positions to allow a height of the pants assembly to be adjusted.

According to a further broad aspect, the invention provides a protective pant for a wearer, the protective pant comprising: a waist portion for overlying a waist of the wearer; a pelvic portion for overlying a pelvic region of the wearer; a pair of leg portions for overlying left and right thighs of the wearer; and a retaining system interconnecting a first part of the protective pant and a second part of the protective pant and configured for moving the first part of the protective pant and the second part of the protective pant relative to one another to adjust a height of the protective pant, the retaining system comprising a first retaining element and a second retaining element that is selectively attachable to and detachable from the first retaining element in different positions to adjust the height of the protective pant.

These and other aspects and features of the present invention will now become apparent to those of ordinary skill in the art upon review of the following description of specific embodiments of the invention in conjunction with the accompanying drawings.

BRIEF DESCRIPTION OF THE DRAWINGS

A detailed description of the embodiments of the present invention is provided herein below, by way of example only, with reference to the accompanying drawings, in which.

Figure 1:
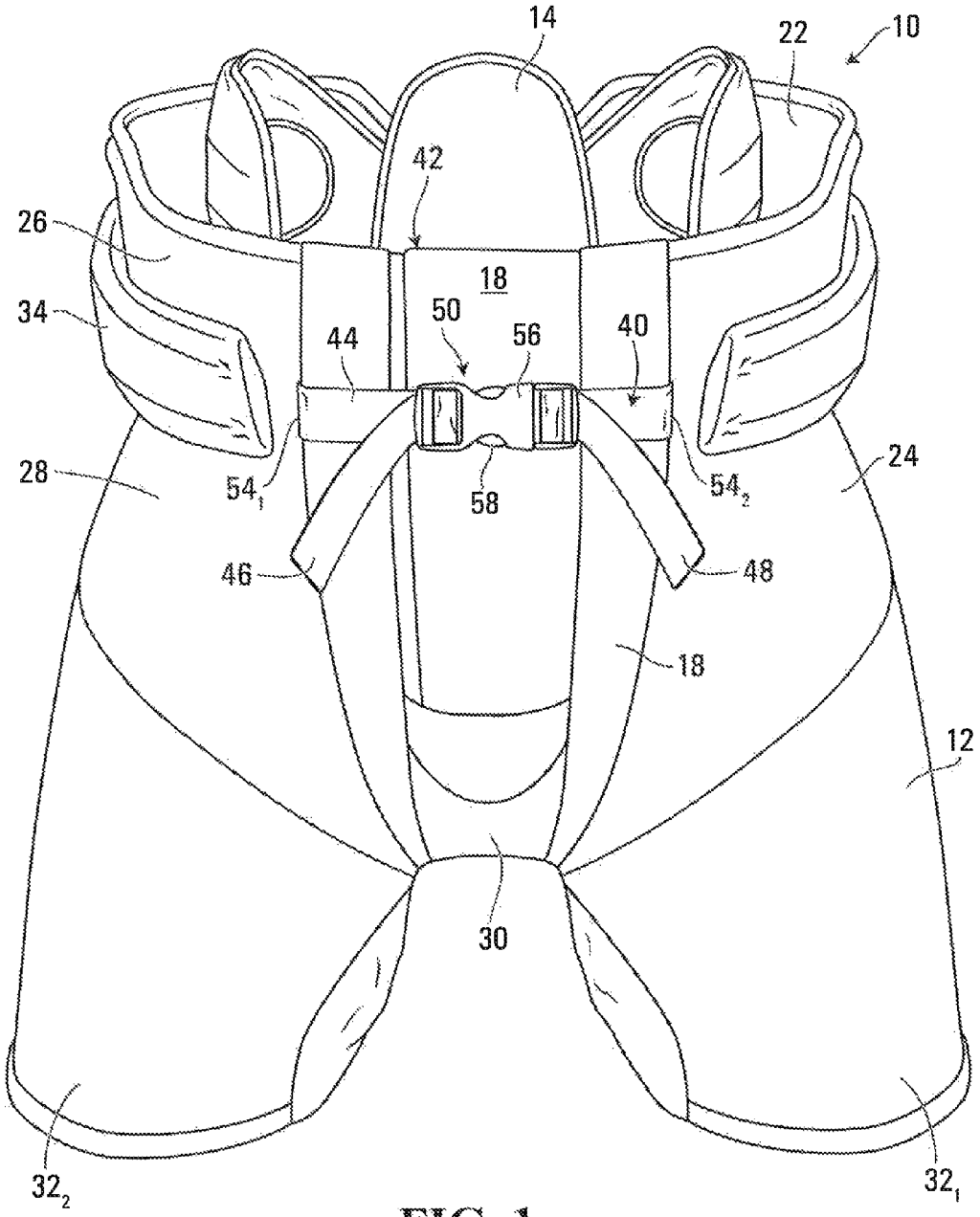
FIGS. 1 to 3 are respective front, side and rear views of a pants assembly comprising an outer shell, inner pants, and a retaining system with first second retainers and a belt.

In the drawings, embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF EMBODIMENTS OF THE INVENTION

To facilitate the description, any reference numeral designating an element in one figure will designate the same element if used in any other figures. In describing the embodiments, specific terminology is resorted to for the sake of clarity but the invention is not intended to be limited to the specific terms so selected, and it is understood that each specific term comprises all equivalents.

Unless otherwise indicated, the drawings are intended to be read together with the specification, and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure. Similarly, the terms "inwardly," "outwardly" and "radially" generally refer to the orientation of a surface relative to its axis of elongation, or axis of rotation, as appropriate.

The embodiments herein presented disclose a pants assembly that not only enables ease of replacement of an outer shell, but also includes inner pants that are specifically configured to offer protection and performance, combined with an outer shell and retaining system that are both versatile and configured to work with the inner pants to offer protection and performance while minimizing restriction of movement.

Figure 2:
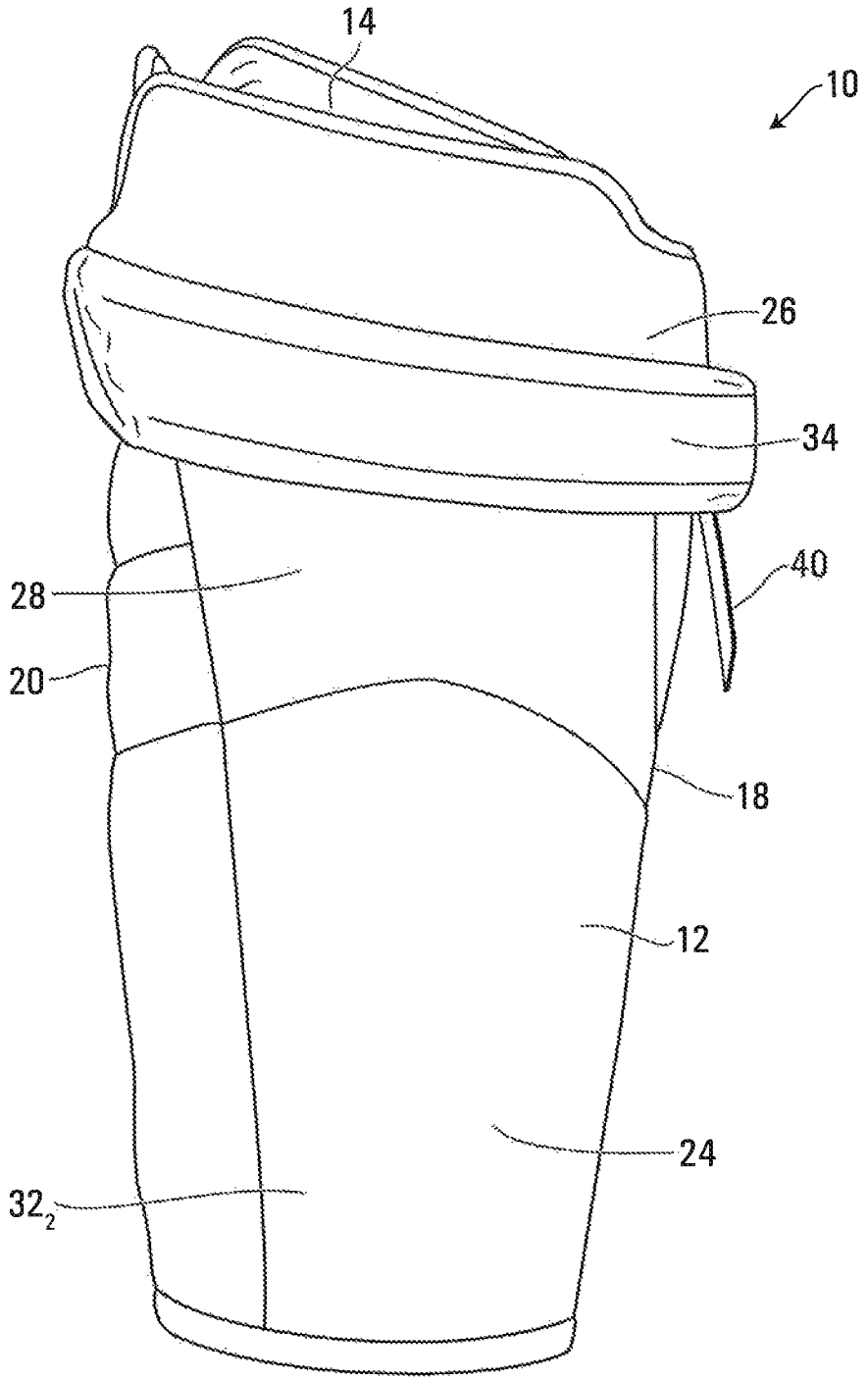
Figure 3:
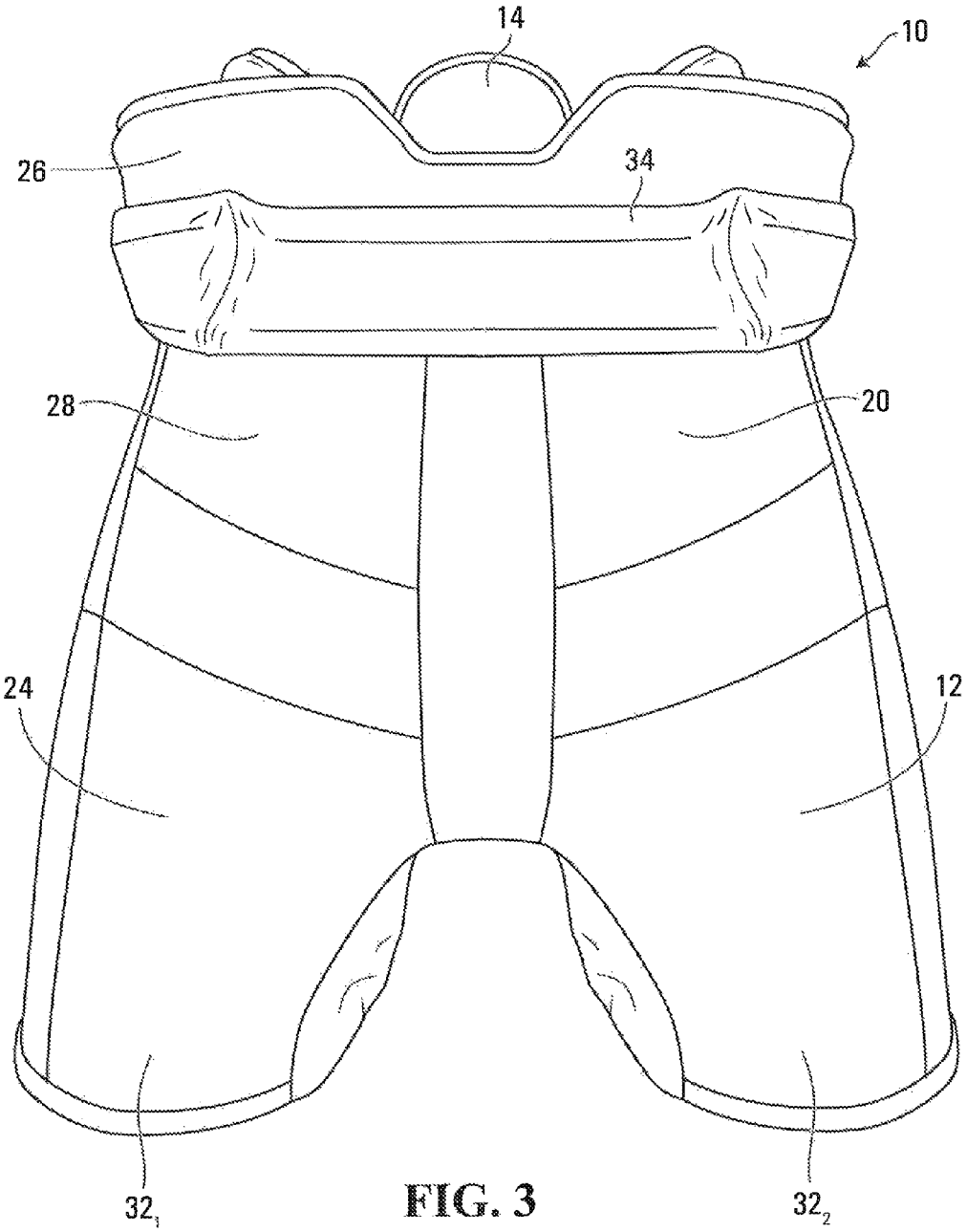

FIGS. 1 to 3 illustrate a pants assembly 10 constructed in accordance with an embodiment of the invention. The pants assembly 10 is a protective athletic equipment wearable by a wearer when playing a sport or performing another athletic activity to protect his/her body against injury. In this embodiment, the pants assembly 10 is a hockey pants assembly for protection of the lower body (e.g. lower spine region, lower ribs, waist, pelvic region with left and right hips, crotch region, genital area, and left and right thighs) of a hockey player playing hockey.

The pants assembly 10 comprises an outer shell 12, inner pants 14 and a retaining system 16 for coupling the inner pants 14 to the outer shell 12. As will be further described below, the retaining system 16 allows the outer shell 12 to move relative to the inner pants 14 and to remove the outer shell 12 from the inner pants 14.

Figure 4:
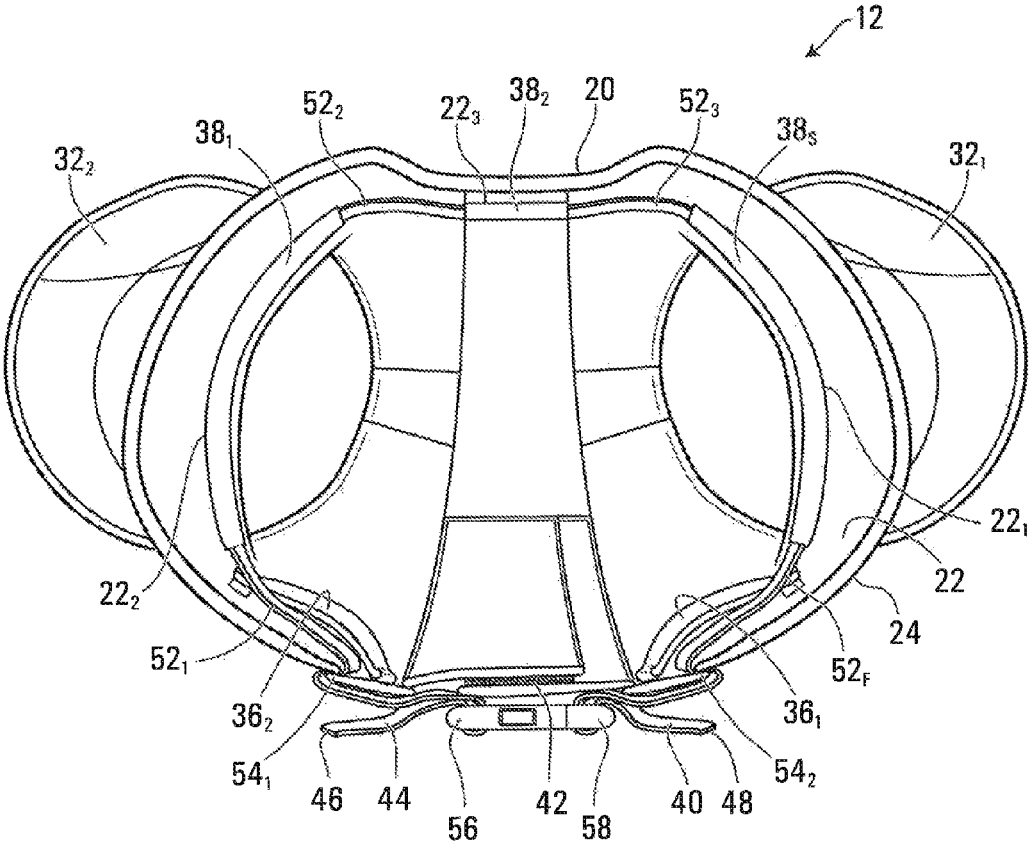
FIG. 4 is a top view of the outer shell with the belt being received in the left, right and rear second retainers of the outer shell.

The outer shell 12 is configured to at least partially cover the inner pants 14 and as such constitutes an outer layer of the pants assembly 10. The outer shell 12 has a front side 18, a rear side 20, and inner and outer sides 22, 24. Referring to FIGS. 1 to 4, the outer shell 12 also comprises a waist portion 26 for covering the waist of the player, a pelvic portion 28 for covering the pelvic region of the player, a crotch portion 30 for covering the crotch region of the player, and left and right leg portions $\mathbf{32}_1$, $\mathbf{32}_2$ for covering at least partially the left and right thighs of the player. At the waist portion 26 and on the outer side 24, the outer shell 12 comprises a waistband protector 34 substantially surrounding the waist of the player for protection thereof. As best seen in FIG. 4, on the inner side 22, the outer shell 12 comprises left and right lower thigh pads $\mathbf{36}_1$, $\mathbf{36}_2$ for at least partially covering the left and right thighs of the player. On the front side 18, the outer shell 12 comprises a fastening mechanism 42 for fastening the outer shell 12 around the player's waist. In this embodiment, the fastening mechanism 42 comprises complementary VELCRO™ hook and loop fasteners; however the fastening mechanism 42 may comprise any other suitable fasteners in other embodiments. It is understood that the fastening mechanism is optional and the retaining system 16 may be the sole means for fastening the outer shell and inner pants around the player's waist.

The outer shell 12 comprises a high strength material such as nylon. Moreover, the outer shell 12 fits generally loosely at least through the left and right leg portions $\mathbf{32}_1$, $\mathbf{32}_2$ and thus typically does not need to be formed of a stretchy fabric, but will still accommodate significant skating movements of the player. However, the outer shell 12 may have stretch zones that employ a stretchy fabric so as to accommodate vigorous skating by the player. For instance, a stretch zone can be provided generally in the crotch portion 30 and in selected areas of high tension or high risk of binding when the player skates so that the outer shell 12 does not inhibit the skating motion.

Figure 6:
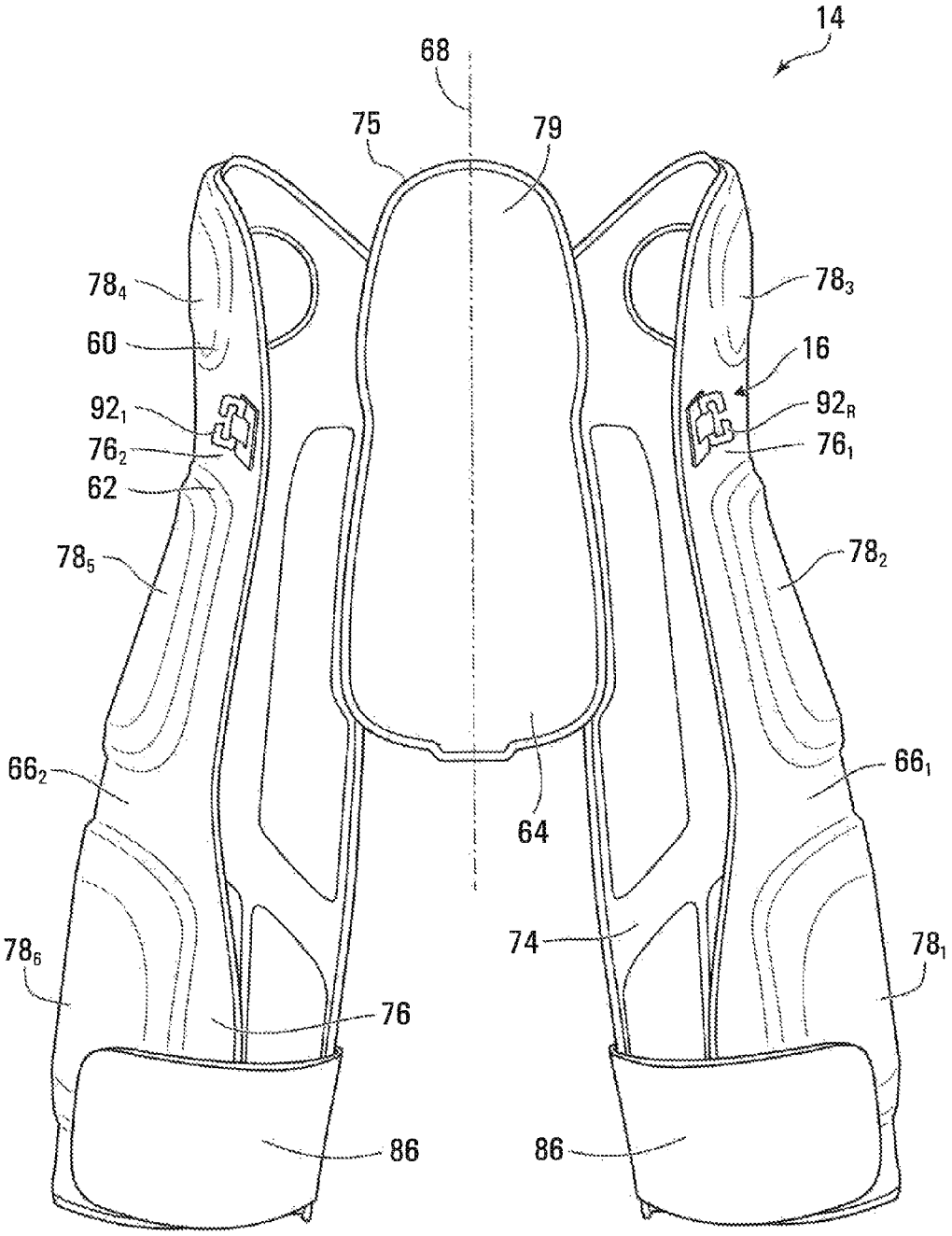
FIGS. 6 to 8 are respective front, side and rear views of the inner pants with front left and right and rear left and right first retainers mounted to the outer side of the inner pants at the waist portion.
Figure 7:
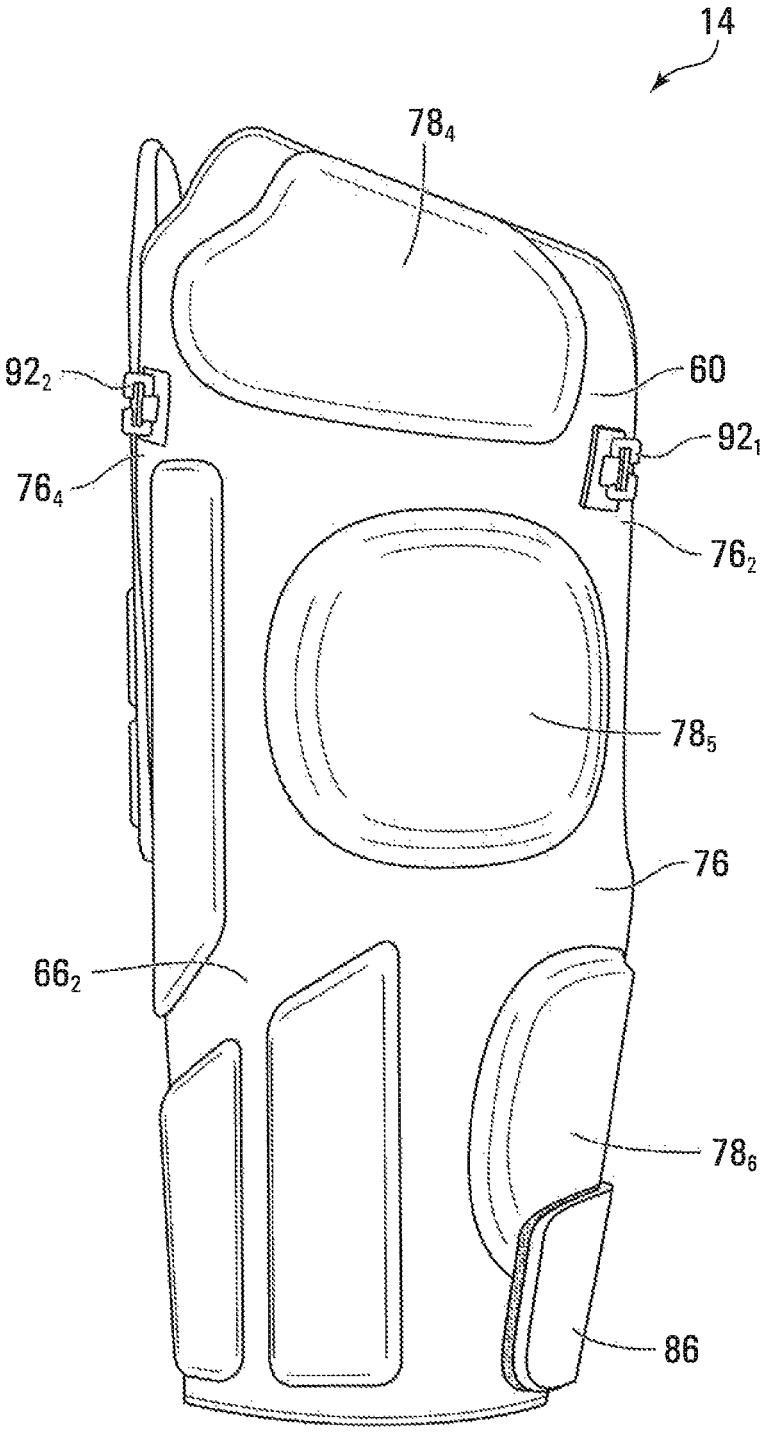
Figure 8:
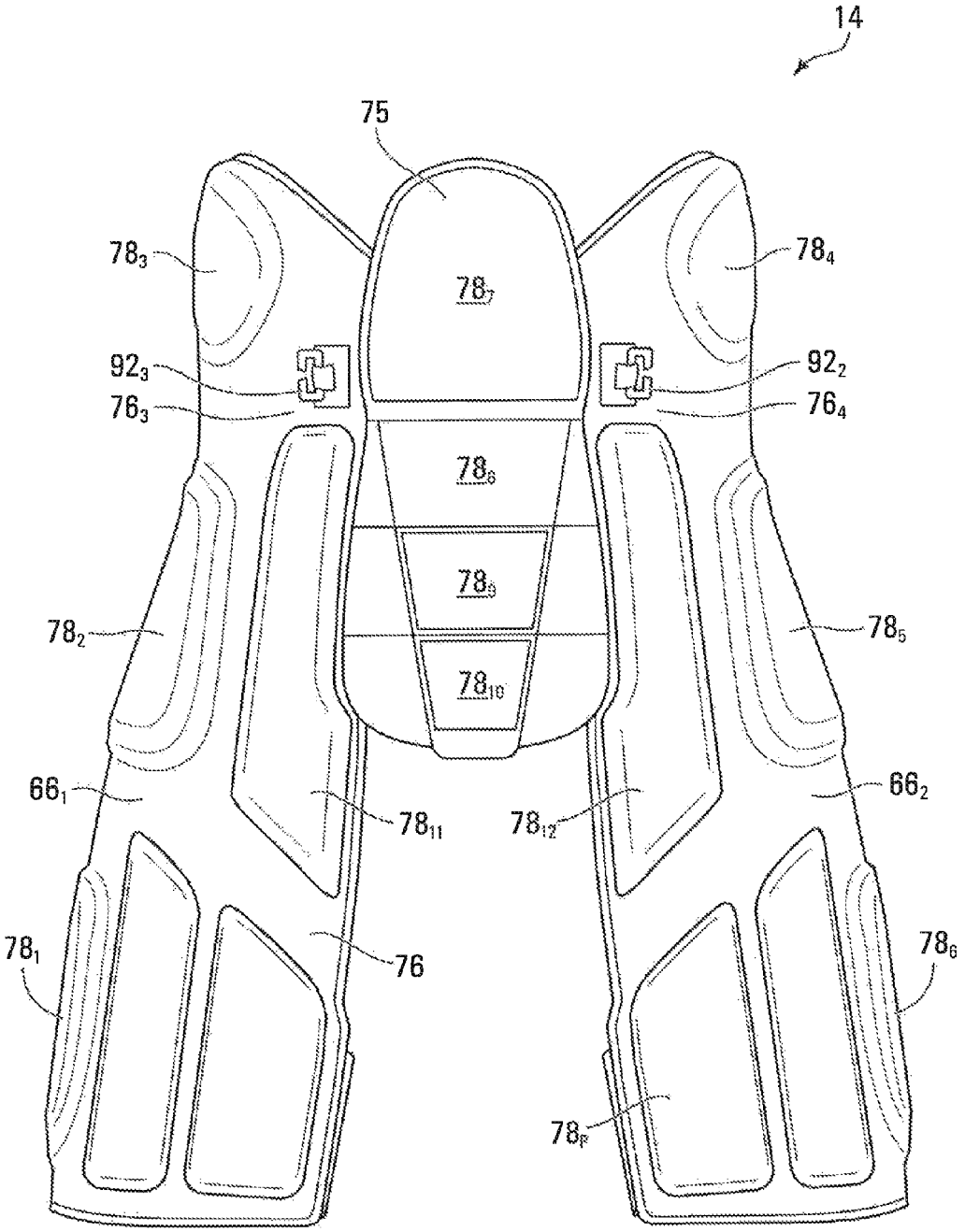
Figure 9:
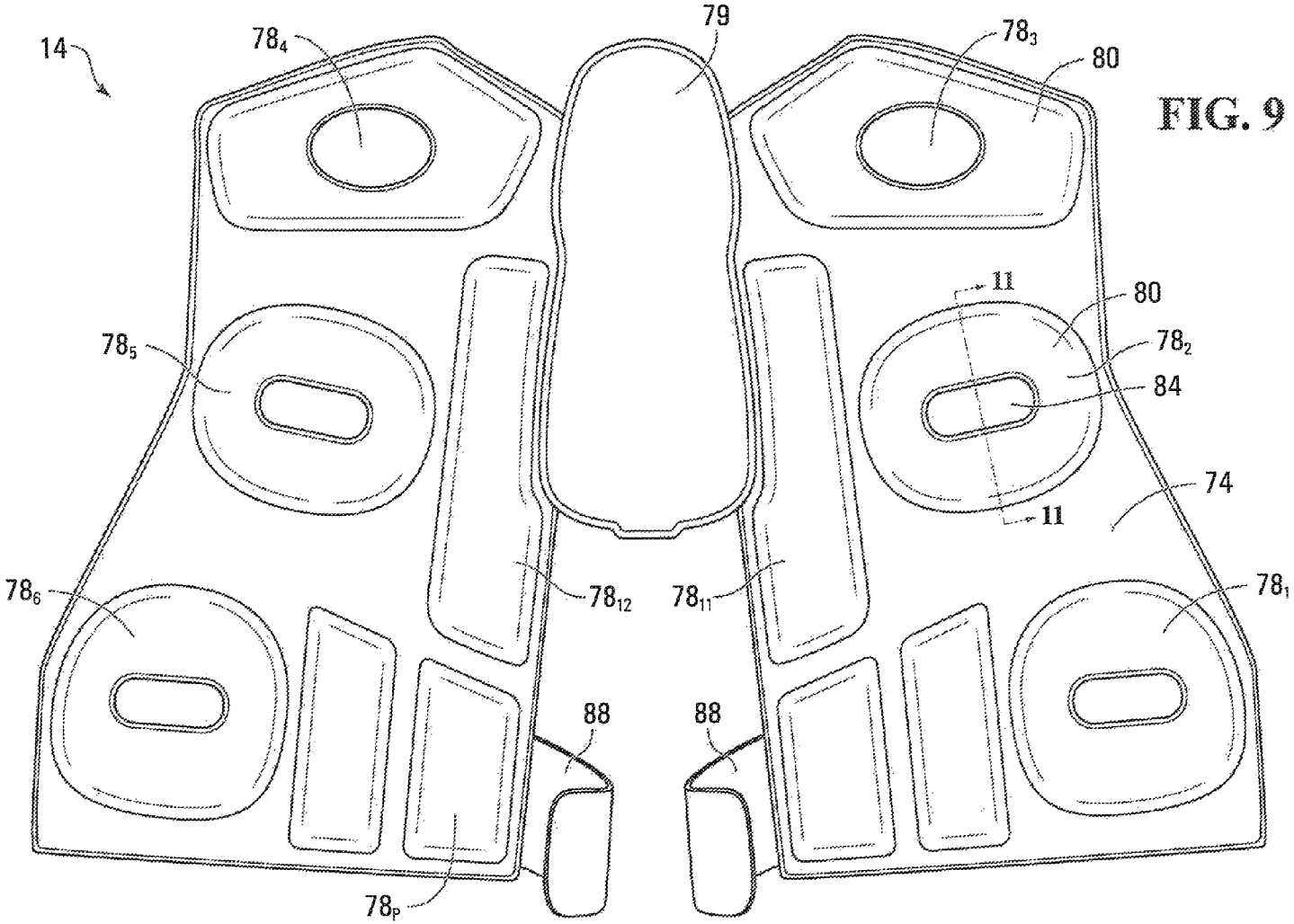
FIGS. 9 and 10 respectively show inner and outer sides of the inner pants in an unrolled configuration.
Figure 10:
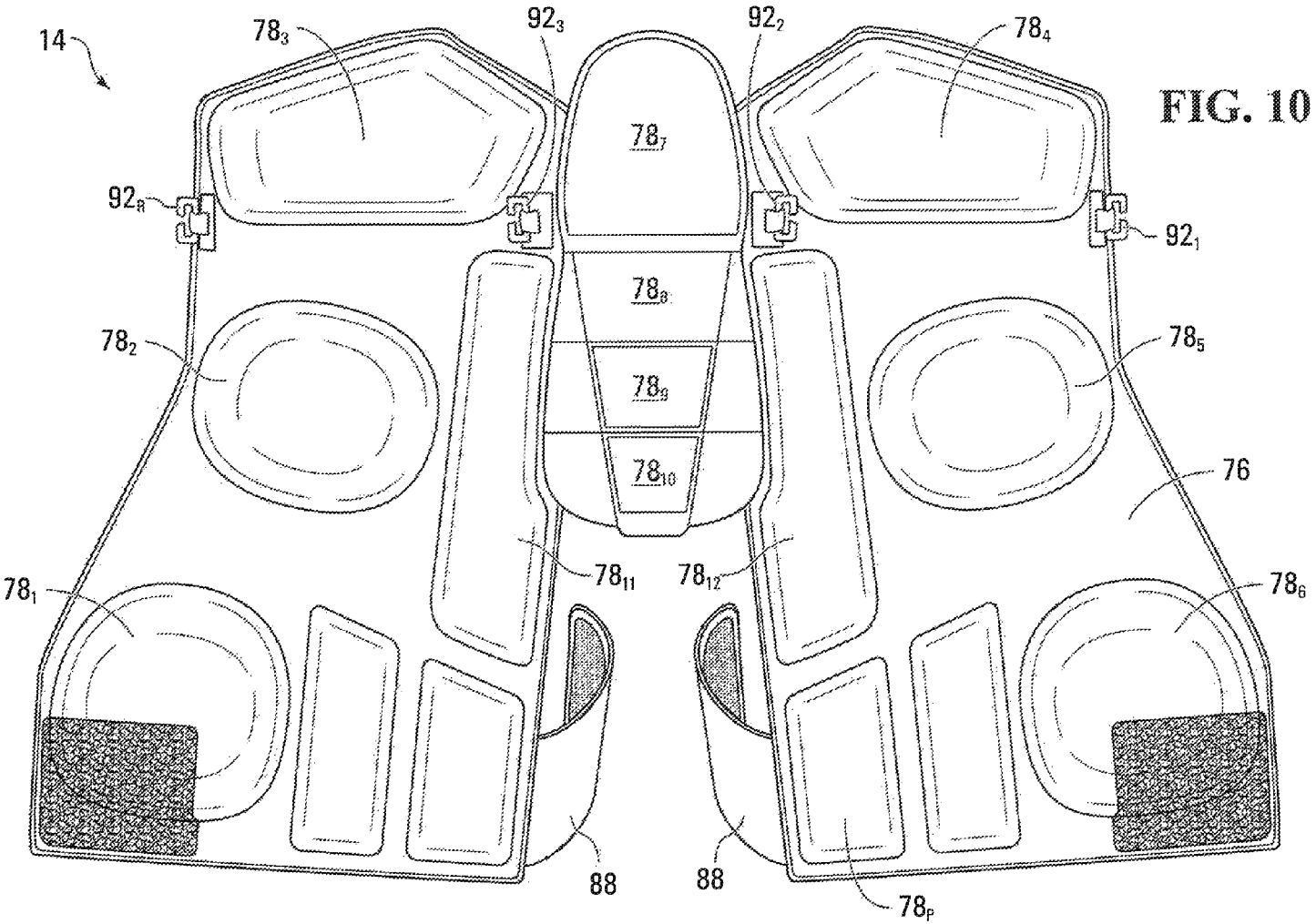
Figure 11:
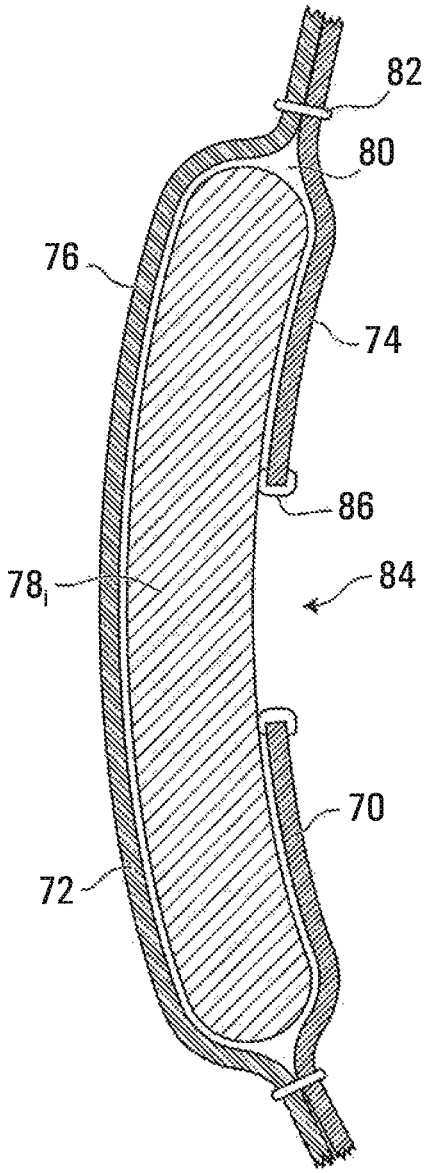
FIG. 11 is an enlarged cross-sectional view of a padding element within a pocket of the inner pants taken along line 11-11.

The inner pants 14 are configured to provide a bulk of the impact protection to the pants assembly 10. With reference to FIGS. 6 to 10, the inner pants 14 are in the form of a short or girdle and comprise a waist portion 60 for covering the waist region of the player, a pelvic portion 62 for covering the pelvic region of the player, a crotch portion 64 for covering the crotch region of the player, and left and right leg portions $\mathbf{66}_1$, $\mathbf{66}_2$ for covering at least partially the left and right thighs of the player. As best shown in FIGS. 6 and 11, the inner pants 14 have a longitudinal axis 68 and comprise first and second fabric layers 70, 72 which respectively define an inner and an outer side 74, 76 of the inner pants 14. To afford impact protection to the player, the inner pants 14 comprise a plurality of padding elements $\mathbf{78}_1$-$\mathbf{78}_P$. As best seen in FIGS. 9 and 10 which show the inner pants 14 in an unrolled configuration, the plurality of padding elements $\mathbf{78}_1$-$\mathbf{78}_P$ includes left and right hip pads $\mathbf{78}_3$, $\mathbf{78}_4$ for covering the left and right hips of the player, left and right upper thigh pads $\mathbf{78}_2$, $\mathbf{78}_5$ partially overlapping the respective left and right hip pads $\mathbf{78}_3$, $\mathbf{78}_4$ for at least partially covering the left and right thighs of the player and being slightly movable relative to the respective left and right hip pads $\mathbf{78}_3$, $\mathbf{78}_4$, and left and right lower thigh pads $\mathbf{78}_1$, $\mathbf{78}_6$ for at least partially covering the left and right thighs of the player. On the inner side 74, the inner pants 14 also comprise a spine pad 79 located centrally relative to the inner pants 14 and extending across the waist and pelvic regions 60, 62 thereof. The spine pad 79 comprises a soft material for providing a comfortable support for the player's spine and tailbone. As best shown in FIG. 10, at the same position but on the outer side 76, the inner pants 14 comprise padding elements $\mathbf{78}_7$-$\mathbf{78}_{10}$ for providing impact protection to the player's spine and tailbone.

As best seen in FIG. 11, each padding element $\mathbf{78}_i$ of the plurality of padding elements $\mathbf{78}_1$-$\mathbf{78}_P$ is contained within a corresponding pocket 80 that is defined between the first and second fabric layers 70, 72 of the inner pants 14. In this embodiment, the pocket 80 is delimited by a stitching 82, however any other suitable method may be used to delimit the pocket 80. Moreover, some of the padding elements $\mathbf{78}_1$-$\mathbf{78}_P$ may be inserted or removed from the inner pants 14 via an opening 84 located at a respective pocket 80. The opening 84 is stretchable such that it may expand and retract to accommodate the insertion or removal of a padding element $\mathbf{78}_i$ into the pocket 80. To this end, an elastic element 86 is affixed at the boundary of the opening 84. In some embodiments, every pocket 80 may comprise an opening 84 to insert/remove a respective padding element $\mathbf{78}_i$ whereas in other embodiments, none of the pockets 80 may comprise an opening such that the padding elements $\mathbf{78}_1$-$\mathbf{78}_P$ are non-removably enclosed within the pockets 80.

The padding elements $\mathbf{78}_1$-$\mathbf{78}_P$ may comprise any suitable material. For instance, the left and right hip pads $\mathbf{78}_3$, $\mathbf{78}_4$ comprise a rigid material in order to provide superior impact protection. The rigid material may comprise expanded polypropylene foam, high-density foam enclosed in polyethylene, or any other suitable material. Other ones of the padding elements $\mathbf{78}_1$-$\mathbf{78}_P$ may comprise a more flexible material which, while still providing some amount of impact protection, is generally less rigid than the rigid material. For instance, this is the case for the padding elements $\mathbf{78}_{11}$, $\mathbf{78}_{12}$ which comprise perforated foam pads. Any of the padding elements $\mathbf{78}_1$-$\mathbf{78}_P$ may comprise a rigid or flexible material accordingly. In addition, the padding elements $78_1$-$78_P$ may be curved and shaped so as to provide good protection while still maintaining player comfort.

In this embodiment, the first and second fabric layers 70, 72 of the inner pants 14 comprise a synthetic mesh material which may allow an increased breathability of the inner pants 14. The first and second fabric layers 70, 72 of the inner pants 14 may comprise any other suitable material in other embodiments.

As best seen in FIGS. 6, 7, 9 and 10, in order to provide an adjustable fit to the legs of the player, each of the left and right leg portions $66_1$, $66_2$ of the inner pants 14 comprises a strap 88. The strap 88 includes a fastening mechanism and may include a protective element. The fastening mechanism may comprise complementary VELCRO™ hook and loop fasteners but may comprise any other suitable fastener in other embodiments.

In yet other embodiments, the inner pants 14 may not comprise straps at the left and right leg portions $66_1$, $66_2$ at all but may instead comprise an elastic element that tightens around the wearer's legs. In such embodiments, the inner pants 14 may not be unrolled.

Referring to FIGS. 1, 4, 14, 15A and 15B, the retaining system 16 comprises a belt 40 including a strip 44 having first and second ends 46, 48 and a belt connector mechanism 50 for fastening the belt 40 and adjusting a functional length thereof. The belt 40 traverses from the outer side 24 to the inner side 22 of the outer shell 12. The first and second ends 46, 48 of the strip 44 of the belt 40 traverse from the inner side 22 to the outer side 24 of the outer shell 12 via respective belt openings $54_1$, $54_2$ (e.g., slits) located on the front side 18 of the outer shell 12. Hence, the belt 40 has a first portion outside the outer shell 12 and adjacent the outer side 24 of the outer shell 12 and a second portion inside the outer shell 12 and adjacent the inner side 22 of the outer shell 12 and the outer side 76 of the inner pants 14 such that the belt second portion at least partially encircles the inner pants 14 at the waist portion 60.

The connector mechanism 50 of the belt 40 is located on the front side 18 of the outer shell 12 and comprises complementary buckle clips 56, 58 located proximate to the first and second ends 46, 48 of the strip 44. The complementary clips 56, 58 allow fastening the belt 40 and adjusting the functional length of the belt 40 (i.e., a distance between the clips 56, 58 measured along the strip 44 of the belt 40 and along the waist). This allows adjusting the fit of the outer shell 12 and inner pants 14 and thus the pants assembly 10 around the waist of the player. In other embodiments, the belt connector mechanism may comprise any other suitable complementary connectors. The belt connector may also be omitted and the ends of the belt may comprise for instance complimentary VELCRO™ hook and loop fasteners for fastening together the belt ends.

Figure 14:
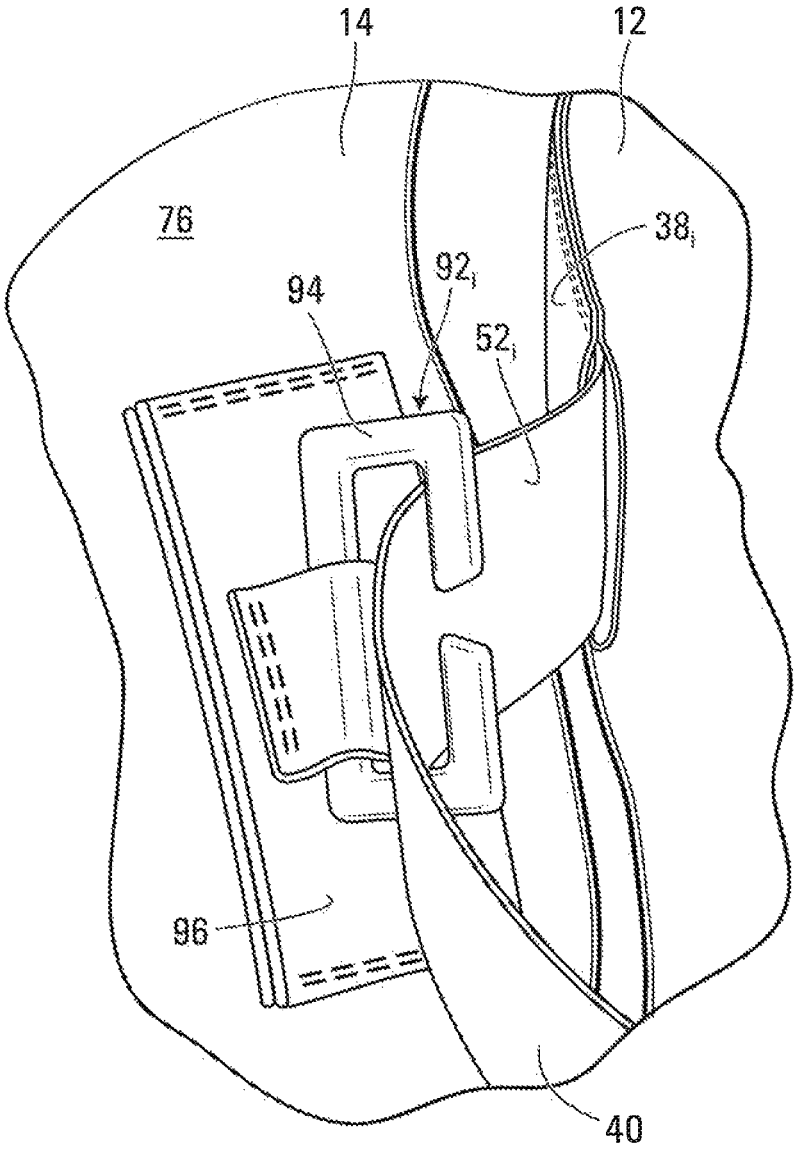
FIG. 14 is an enlarged fragmentary perspective view of the first retainer mounted to the outer side of the inner pants with an exposed portion of the belt being received in the first retainer and another portion of the belt being received in the second retainer that is mounted to the inner side of the outer shell.
Figure 15A:
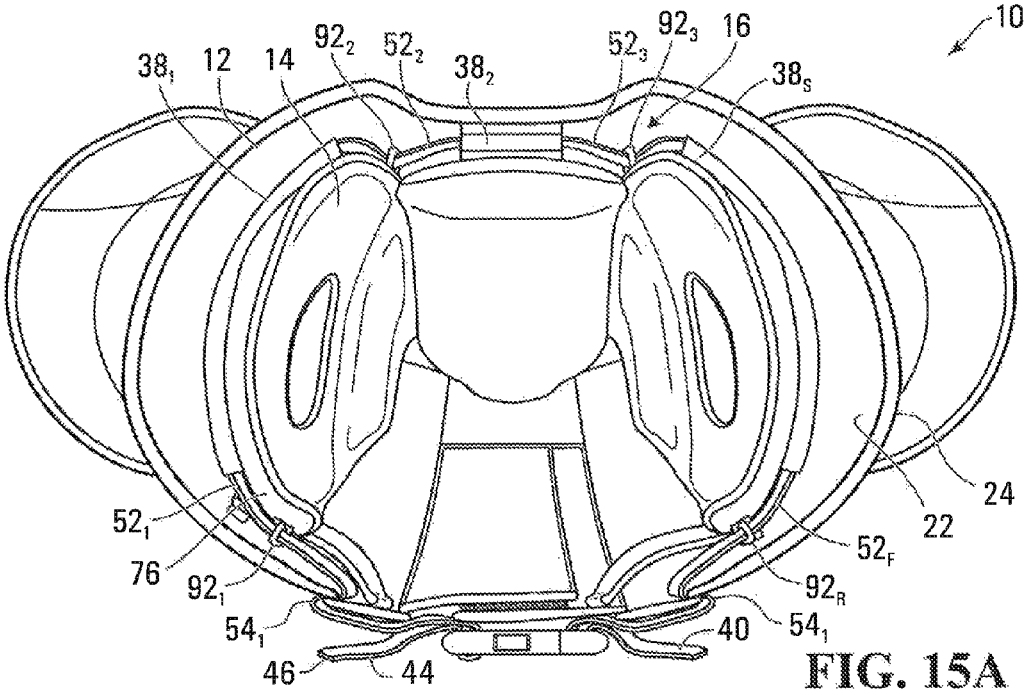
FIG. 15A is a top view of the pants assembly of FIGS. 1 to 3 with the outer shell being in a first position relative to the inner pants
Figure 15B:
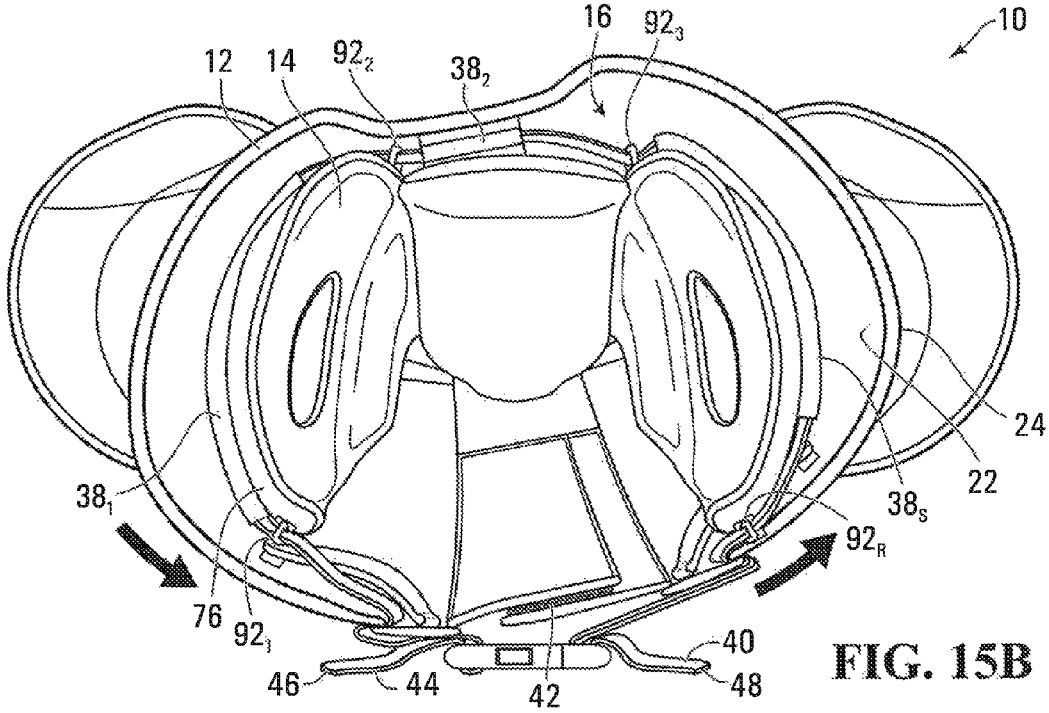
FIG. 15B is a top view of the pants assembly of FIGS. 1 to 3 with the outer shell being in a second position relative to the inner pants.

Reverting to FIGS. 14, 15A and 15B, the retaining system 16 also comprises a first retainer $92_i$ among a plurality of first retainers $92_1$-$92_R$ mounted on the outer side 76 and along the waist portion 60 of the inner pants 14 and a second retainer $38_i$ among a plurality of second retainers $38_1$-$38_S$ mounted on the inner side 22 and along the waist portion 26 of the other shell 12.

Figure 5:
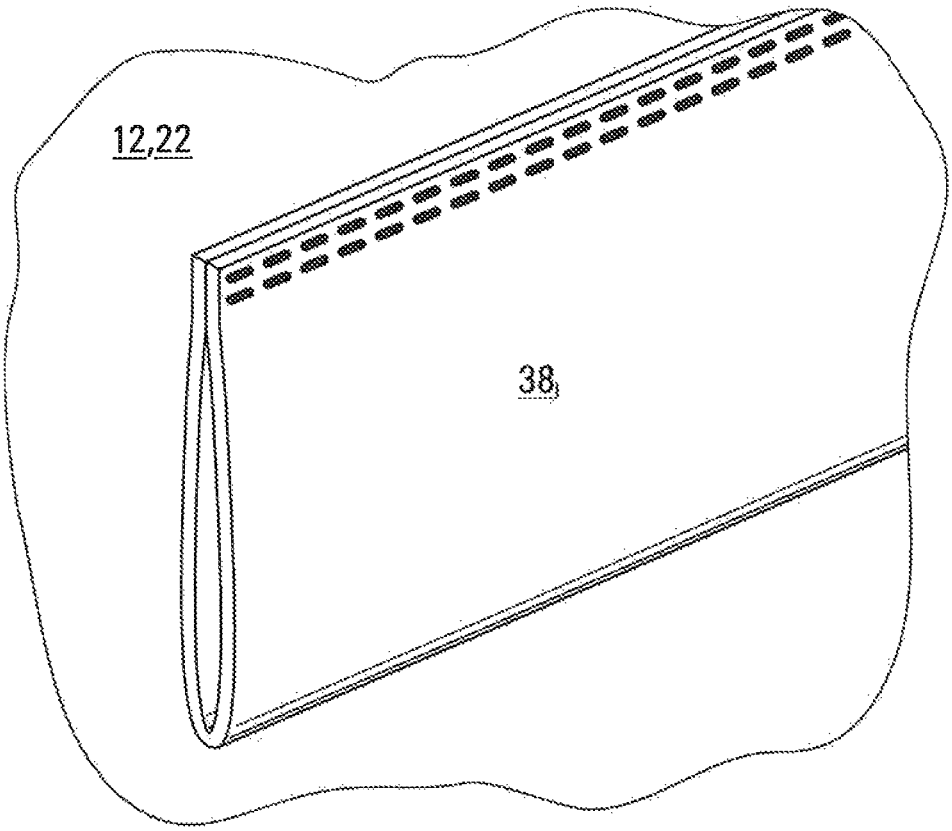
FIG. 5 is an enlarged fragmentary perspective view of the second retainer of the outer shell.

As best seen in FIGS. 4 and 5, the second retainer $38_i$ may be a sleeve and may comprise a strip of material folded onto itself and affixed at its lateral top ends to the inner side 22 of the outer shell 12. In this embodiment, the second retainers $38_1$-$38_S$ are affixed to the outer shell 12 via stitching. However, any other suitable method may be used to affix the second retainers $38_1$-$38_S$ or sleeves to the outer shell 12 in other embodiments. The second retainer may also be a hook, a loop or any other type of retainer configured to retain the belt 40 while allowing movement of the outer shell 12 relative to the belt 40. On the inner side 22 of the outer shell 12, the belt 40 is partially contained within the sleeves $38_1$-$38_S$ of the outer shell 12 and thus the belt 40 comprises a plurality of exposed portions $52_1$-$52_F$ that are not contained within the plurality of sleeves $38_1$-$38_S$. That is, each exposed portion $52_i$ begins at the end of a sleeve $38_i$ and ends at the beginning of the next sleeve $38_j$. In this embodiment, the outer shell 12 comprises left, right and rear second retainers or sleeves and the belt 40 comprises four exposed portions $52_n$. More particularly, the retaining system 16 has a left second retainer $38_S$ mounted to a left portion $22_1$ of the inner side 22 of the outer shell 12 at the waist portion 26, a right second retainer $38_1$ mounted to a right portion $22_2$ of the inner side 22 of the outer shell 12 at the waist portion 26, and a rear second retainer $38_2$ mounted to a rear portion $22_3$ of the inner side 22 of the outer shell 12 at the waist portion 26. The left, right and rear second retainers $38_1$-$38_S$ are slidable along the belt 40 for allowing movement of the outer shell 12 relative to the inner pants 14. It is understood that in other embodiments, the retaining system 16 may comprise more or less second retainers, sleeves or loops.

Figure 12:
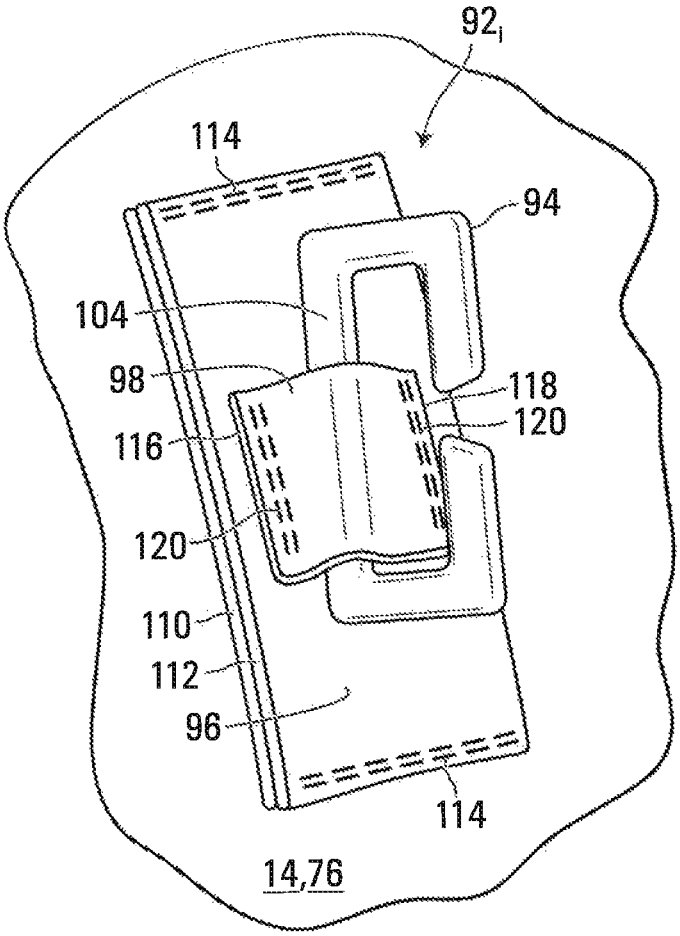
FIG. 12 is an enlarged fragmentary perspective view of the first retainer mounted to the outer side of the inner pants.
Figure 13:
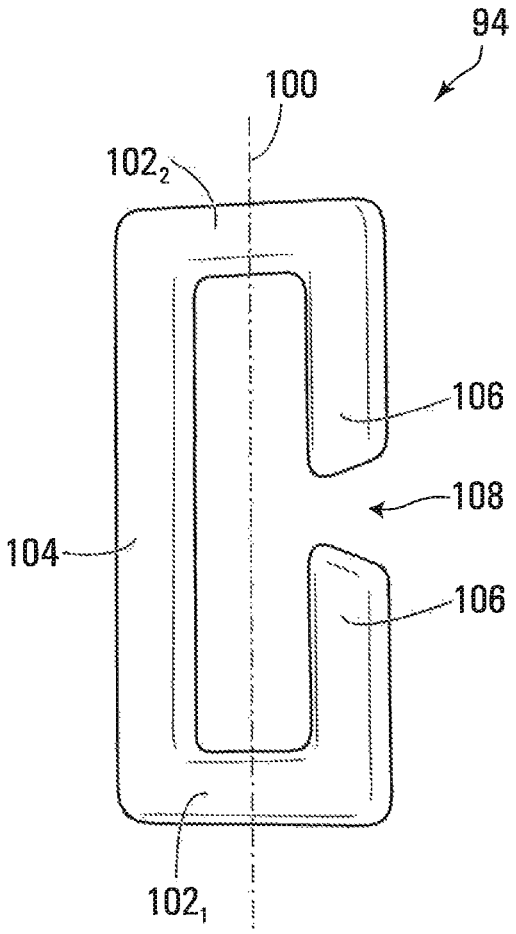
FIG. 13 is an enlarged front view of the first retainer.

As best seen in FIGS. 12 to 14, each first retainer $92_i$ of the plurality of first retainers $92_1$-$92_R$ comprises a retaining member 94 for retaining one exposed portion $52_i$ of the plurality of exposed portions $52_i$-$52_F$ of the belt 40, a backing 96 for affixing the first retainer $92_i$ to the inner pants 14, and an attachment member 98 for affixing the retaining member 94 to the backing 96. In this embodiment, as best seen in FIG. 13, the retaining member 94 is C-shaped and extends along a longitudinal axis 100. The retaining member 94 comprises first and second transversal portions $102_1$, $102_2$, a continuous longitudinal portion 104, and a discontinuous longitudinal portion 106. It is understood that the different portions of the retaining member 94 are "longitudinal" in that they extend in the same direction as the longitudinal axis 100 or "transversal" in that they extend in a direction transversal to the longitudinal axis 100. The discontinuous longitudinal portion 106 is "discontinuous" in that it defines an opening 108 proximate its midsection. In this embodiment, the retaining member 94 comprises a plastic material (e.g., nylon, polyethylene, silicon). In other embodiments, the retaining member 94 may comprise any suitable material.

The backing 96 comprises a rigid member 110 and a layer of fabric 112 overlying the rigid member 110. The rigid member 110 may comprise a strip of plastic material (e.g., polyethylene, nylon or silicon) or any other suitable material. A stitching 114 is used to affix the backing 96 onto the outer side 76 of the inner pants 14. Any other suitable method of affixing the backing 96 to the inner pants 14 may be used in other embodiments (e.g., ultrasonic welding or adhesive bonding). In some embodiments the layer of fabric 112 may be omitted altogether.

The attachment member 98 is adapted to affix the retaining member 94 to the backing 96 and to the inner pants 14. To this end, the attachment member 98 comprises a strip of fabric that overlies the continuous longitudinal portion 104 of the retaining member 94. The attachment member 98 is affixed at its longitudinal end portions 116, 118 to the backing 96 and to the inner pants 14 via a stitching 120 that traverses both the backing 96 and the inner pants 14. The retaining member 94 is thus secured to the outer side 76 of the inner pants 14 while maintaining a generally vertical alignment relative to the inner pants 14. That is, while the retaining member 94 has a certain range of motion when it is secured by the attachment member 98, the longitudinal axis 100 of the retaining member 94 remains generally aligned with the longitudinal axis 68 of the inner pants 14.

It is understood that the attachment member and/or backing may be omitted in other embodiments where the retaining member itself can be directly or indirectly affixed to the inner pants.

As best shown in FIGS. 6 to 8, 15A and 15B, the retaining system 16 comprises a front left first retainer $\mathbf{92}_R$ mounted to a front left portion $\mathbf{76}_1$ of the outer side 76 of the inner pants 14 at the waist portion 60, a front right first retainer $\mathbf{92}_1$ mounted to a front right portion $\mathbf{76}_2$ of the outer side 76 of the inner pants 14 at the waist portion 60, a rear left first retainer $\mathbf{92}_3$ mounted to a rear left portion $\mathbf{76}_3$ of the outer side 76 of the inner pants 14 at the waist portion 60, and a rear right first retainer $\mathbf{92}_2$ mounted to a rear right portion $\mathbf{76}_4$ of the outer side 76 of the inner pants 14 at the waist portion 60. The belt 40 is removably received in these four first retainers such that the outer shell 12 is removable from the inner pants 14. It is understood that the belt 40 remains on the outer shell 12 when the outer shell 12 is removed from the inner pants 14.

Each exposed portion $\mathbf{52}_i$ of the belt 40 is engaged by a retaining member 94 of a respective first retainer $\mathbf{92}_i$. In order to engage the exposed portion $\mathbf{52}_i$ of the belt 40 to the retaining member 94, the exposed portion $\mathbf{52}_i$ of the belt 40 is slipped into the opening 108 of the discontinuous longitudinal portion 106 of the retaining member 94 such that the exposed portion $\mathbf{52}_i$ of the belt 40 is entirely bounded by the first and second transversal portions $\mathbf{102}_1$, $\mathbf{102}_2$, the continuous longitudinal portion 104, and the discontinuous longitudinal portion 106 of the retaining member 94. Due in part to its geometry, the retaining member 94 prevents the exposed portion $\mathbf{52}_i$ of the belt 40 from accidentally slipping out through the opening 108 and becoming disengaged from the retaining member 94. In order to disengage the exposed portion $\mathbf{52}_i$ of the belt 40 from the retaining member 94, the exposed portion $\mathbf{52}_i$ of the belt 40 is slipped through the opening 108 of the retaining member 94.

As shown in FIG. 15A, the outer shell 12 is in a first position with respect to the inner pants 14 where each second retainer $\mathbf{38}_i$ is positioned at a first position with respect to the belt 40.

As shown in FIG. 15B, the outer shell 12 is in a second position with respect to the inner pants 14 where the outer shell 12 has moved relative to the inner pants 14 in a direction indicated by the arrows. Each second retainer $\mathbf{38}_i$ is no longer at the first position with respect to the belt 40 and each second retainer $\mathbf{38}_i$ is now positioned at a second position with respect to the belt 40.

The second retainers $\mathbf{38}_1$-$\mathbf{38}_S$ are therefore slidable along the belt 40 such that the outer shell 12 is movable with respect to the inner pants 14 between first and second positions.

The mobility of the outer shell 12 relative to the inner pants 14 may allow the player a greater range of motion and/or more comfort when the outer shell 12 is for example in contact with the board or with pants or other equipment of another player. As such, in use, the outer shell 12 can change positions relative to the inner pants 14. The outer shell 12 is also releasably mountable to the inner pants 14 through the engagement of each exposed portion $\mathbf{52}_i$ of the belt 40 to a retaining member 94 of a respective first retainer $\mathbf{92}_i$ such that the inner pants 14 and outer shell 12 are coupled together at the waist portions 26, 60 while the outer shell 12 is movable relative to the inner pants 14 (i.e. the second retainers or sleeves $\mathbf{38}_1$-$\mathbf{38}_S$ of the outer shell 12 slide along the belt 40). In other words, through the retaining system 16, the inner pants 14 and outer shell 12 are securely retained against the player's waist while the retaining system 16 allows sliding movement of each second retainer $\mathbf{38}_i$ of the outer shell 12 with respect to the belt 40 such that the outer shell 12 is movable with respect to the belt 40 and inner pants 14. In order to remove the outer shell 12 from the inner pants 14, each exposed portion $\mathbf{52}_i$ of the belt 40 is slipped through the opening of each retaining member 94 such that the belt 40 is no longer received in the first retainers $\mathbf{92}_1$-$\mathbf{92}_R$ and such that the outer shell 12 is no longer coupled to the inner pants 14.

Figure 16:
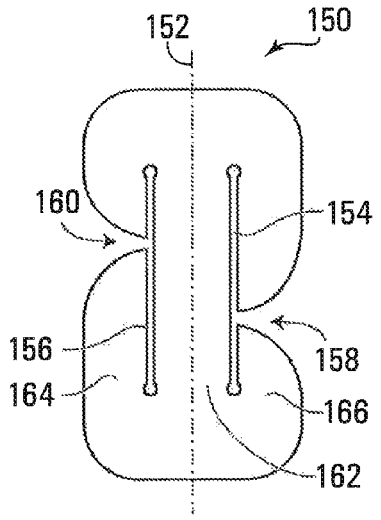
FIGS. 16 and 17 show a first retainer according to a further embodiment.

The first retainers of the retaining system may be configured in various ways. For instance, according to a further embodiment shown in FIGS. 16 and 17, a first retainer 150 has a generally rectangular shape and extends along a longitudinal axis 152. The first retainer 150 comprises first and second slits 154, 156 extending in a direction parallel to the longitudinal axis 152, and first and second openings 158, 160 provided at respective sides of the first retainer 150. The first retainer 150 thus comprises a central portion 162 bounded by the first and second slits 154, 156 and lateral portions 164, 166. The first retainer 150 is affixed to the outer side of the inner pants at the central portion 162. For instance, the first retainer 150 can be affixed to the outer side of the inner pants via a stitching 168. The lateral portions 164, 166 which are not affixed to the inner pants are able to slightly flex for insertion of a belt.

The first retainer 150 does not require a backing or an attachment member since the first retainer itself can be affixed to the inner pants. As such, the first retainer 150 can be thought of as a retaining member in itself.

Figure 17:
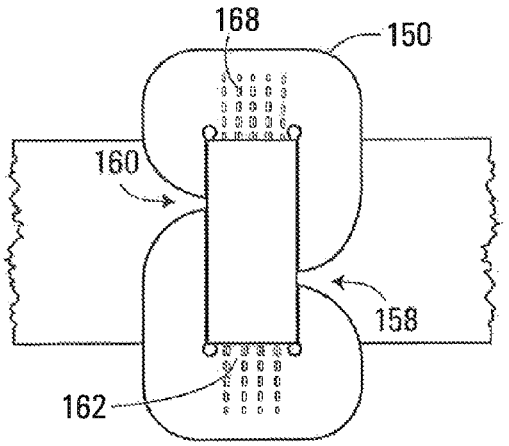

To retain the inner pants onto the outer shell, an exposed portion of the belt is slipped into the first opening 158 and engaged into the first slit 154. The exposed portion of the belt is then also slipped into the second opening 160 and engaged into the second slit 156. The exposed portion of the belt is thus securely engaged to the first retainer 150 and prevented from accidentally slipping out of engagement therewith. As shown in FIG. 17, the exposed portion of the belt runs transversally to the longitudinal axis 152 of the first retainer 150. Once each exposed portion of the belt has been engaged to a respective first retainer 150, the outer shell is retained to the inner pants and is movable with respect to the inner pants.

Figure 18A:
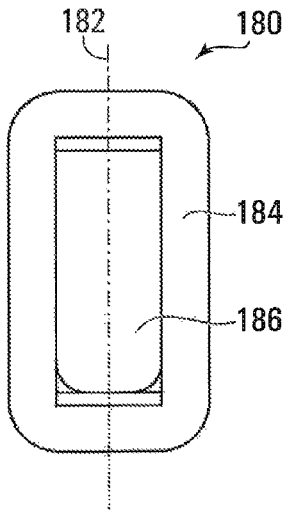
FIGS. 18A, 18B and 19 show a first retainer according to another embodiment.
Figure 18B:
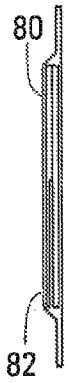
Figure 19:
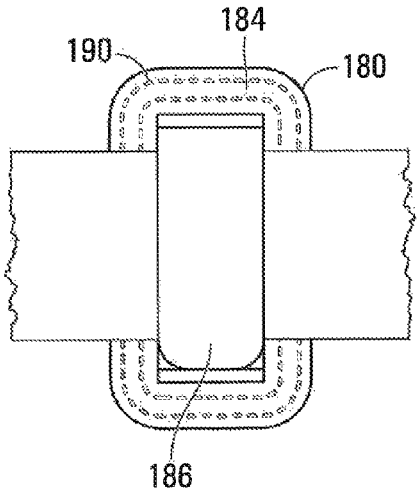

In another embodiment shown in FIGS. 18A, 18B and 19, a first retainer 180 has a generally rectangular shape and extends along a longitudinal axis 182. The first retainer 180 comprises a peripheral base portion 184 and a foldable tab 186 located centrally relative to the peripheral base portion 184. The tab 186 is foldable between a first position where the exposed portion of the belt can be positioned over the first retainer 180 and a second position where the tab 186 retains the exposed portion of the belt while allowing movement (i.e., sliding) of the exposed portion with respect to the first retainer 180. Here, the first retainer 180 is affixed to the outer side of the inner pants at the peripheral base portion 184. For instance, the first retainer 180 can be affixed to the outer side of the inner pants via a stitching 190.

According to a further embodiment, the location of the first retainers and the second retainers may be interchanged. For instance, as shown in FIGS. 20, 21, 22A and 22B, a pants assembly 210 comprises an outer shell 212, inner pants 214, and a retaining system 216, comprising a belt 240, a plurality of first retainers $\mathbf{292}_1$-$\mathbf{292}_R$, mounted to the inner portion 222 of the outer shell 212, and a plurality of second retainers or sleeves $\mathbf{238}_1$-$\mathbf{238}_S$ mounted to the outer portion 276 of the inner pants 214.

Figure 20:
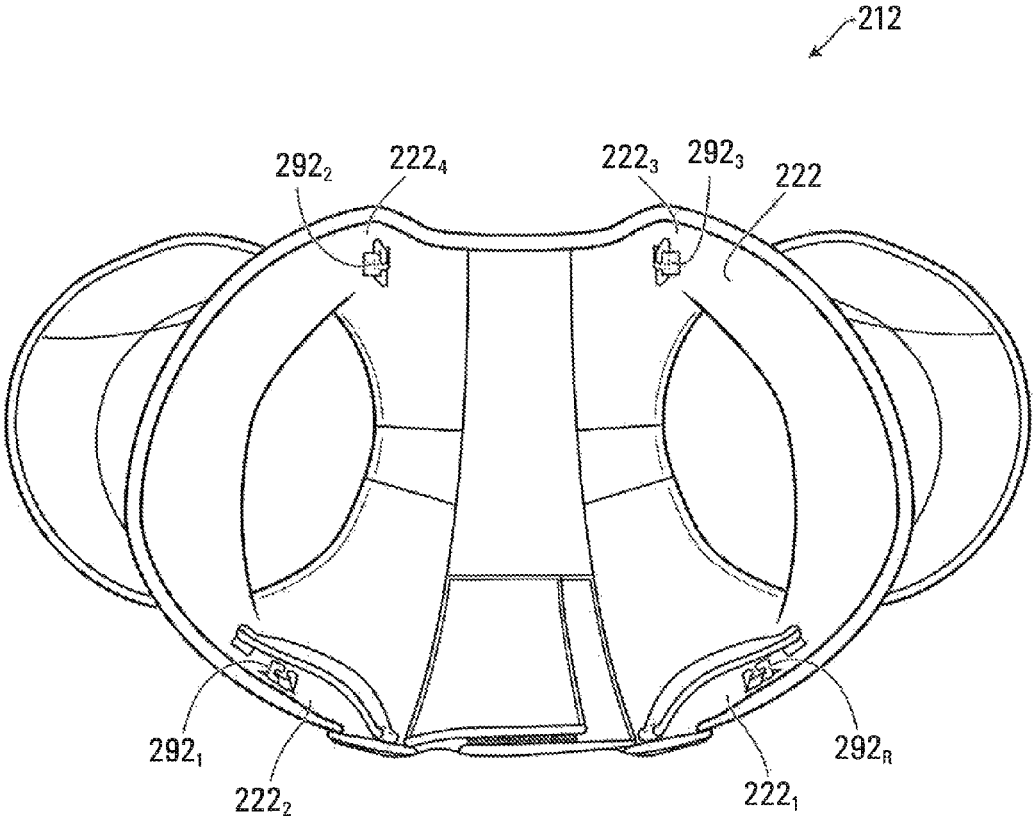
FIGS. 20 and 21 show a further embodiment in which the first retainers are rather mounted to the inner side of the outer shell and the second retainers are rather mounted to the outer side of the inner pants.
Figure 21:
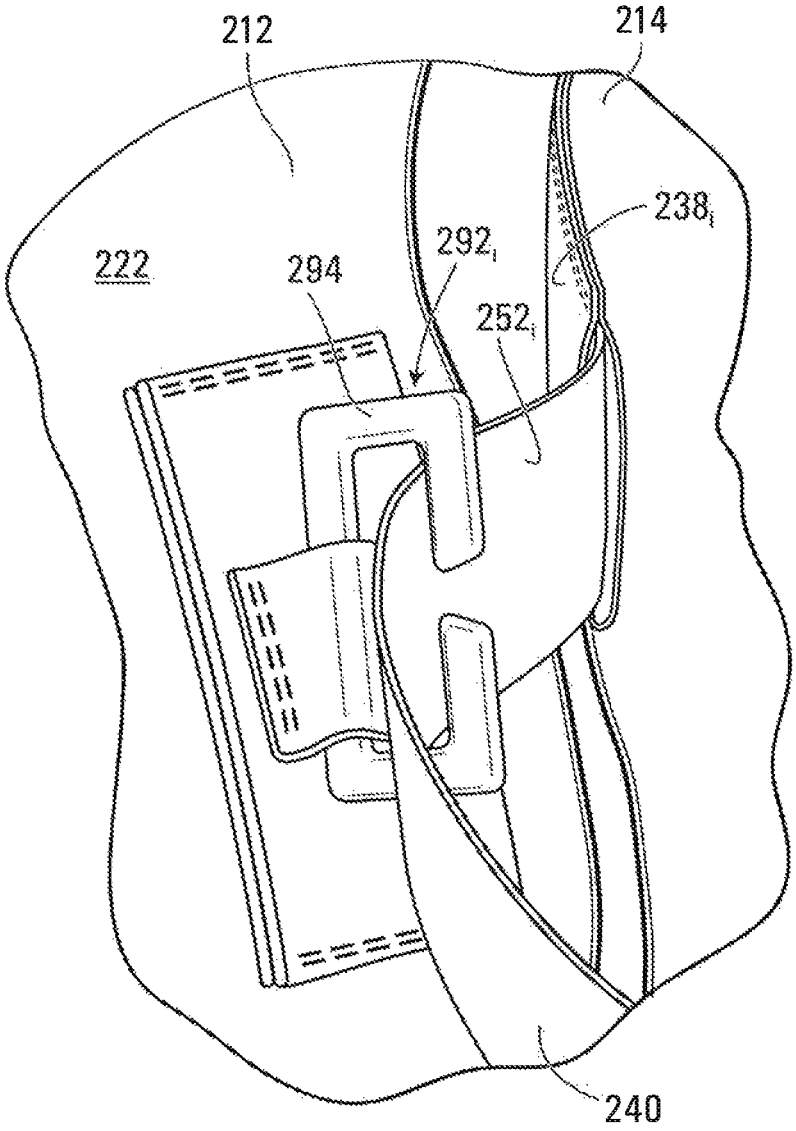

The outer shell 212, as best seen in FIG. 20, is similar to the outer shell 12 with the exception that the outer shell 212 does not comprise sleeves. Rather, the plurality of first retainers $\mathbf{292}_1$-$\mathbf{292}_R$ of the retaining system 216 are affixed at the waist portion and on the inner side 222 of the outer shell 212. More particularly, the retaining system 216 comprises a front left first retainer $\mathbf{292}_R$ mounted to a front left portion $\mathbf{222}_1$ of the inner side 222 of outer shell 212 at the waist portion, a front right first retainer $\mathbf{292}_1$ mounted to a front right portion $\mathbf{222}_2$ of the inner side 222 of the outer shell 212 at the waist portion, a rear left first retainer $\mathbf{292}_3$ mounted to a rear left portion $\mathbf{222}_3$ of the inner side 222 of the outer shell 212 at the waist portion, and a rear right first retainer $\mathbf{292}_2$ mounted to a rear right portion $\mathbf{222}_4$ of the inner side 222 of the outer shell 212 at the waist portion. The belt 240 is removably received in these four first retainers such that the outer shell 212 is removable from the inner pants 214. In this embodiment, because the belt 240 remains on the inner pants 214, it is also necessary to remove the belt 240 from the outer shell 212 and from the belt connector mechanism at the front.

While the first retainers $\mathbf{292}_1$-$\mathbf{292}_R$ are similar to the first retainers $\mathbf{92}_1$-$\mathbf{92}_R$ previously described and allow coupling together the outer shell and inner pants, in this embodiment, they allow the outer shell 212 to move relative to the inner pants 214 by sliding along the belt 240. The inner pants 214 and outer shell 212 are securely retained against the player's waist while the retaining system 216 allows sliding movement of each first retainer $\mathbf{292}_R$ with respect to the belt 240 and of the outer shell 212 with respect to the inner pants 214.

The inner pants 214 are similar to the inner pants 14 described above with the exception that no first retainers are affixed to the inner pants 214. Rather, the inner pants 214 comprise a plurality of sleeves $\mathbf{238}_1$-$\mathbf{238}_S$ on the inner side for receiving the belt 240. More particularly, the retaining system 216 has a left second retainer $\mathbf{238}_S$ mounted to a left portion $\mathbf{276}_1$ of the outer side 276 of the inner pants 214 at the waist portion, a right second retainer $\mathbf{238}_1$ mounted to a right portion $\mathbf{276}_2$ of the outer side 276 of the inner pants 214 at the waist portion, and a rear second retainer $\mathbf{238}_2$ mounted to a rear portion $\mathbf{276}_3$ of the outer side 276 of the inner pants 214 at the waist portion. The belt 240 thus defines a plurality of exposed portions $\mathbf{252}_1$-$\mathbf{252}_F$ each of which is defined between the end of a sleeve to the beginning of the next sleeve of the inner pants 214.

By engaging each exposed portion $\mathbf{252}_i$ of the belt 240 to a retaining member 294 of a respective first retainer $\mathbf{292}_i$, the inner pants 214 are securely retained onto the outer shell 212.

Figure 22A:
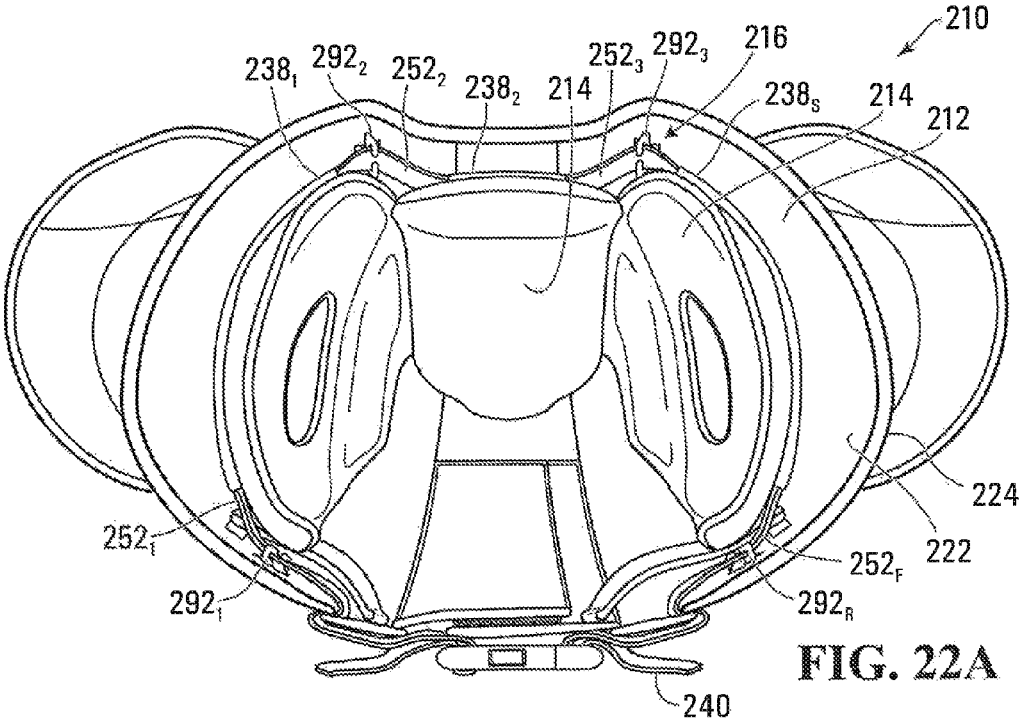
FIG. 22A is a top view of the pants assembly according to the further embodiment with the outer shell being in a first position relative to the inner pants.

FIG. 22A is a top view of the pants assembly 210 where the outer shell 212 is in a first position with respect to the inner pants 214 and where each first retainer $\mathbf{292}_i$ is positioned approximately at midlength of a corresponding exposed portion $\mathbf{252}_i$ of the belt 240.

Figure 22B:
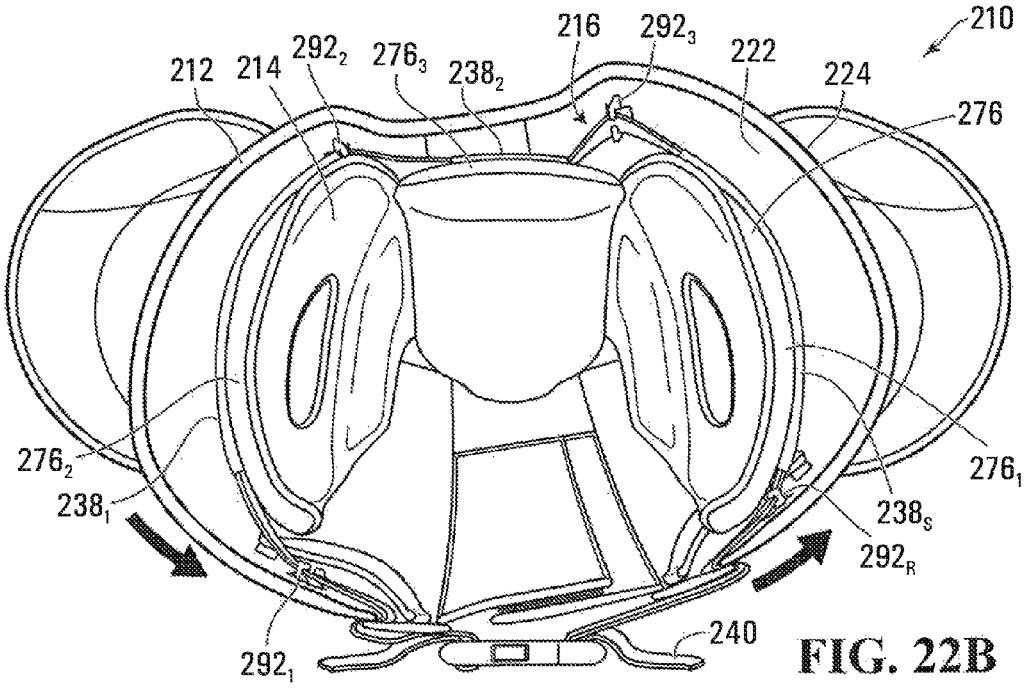
FIG. 22B is a top view of the pants assembly according to the further embodiment with the outer shell being in a second position relative to the inner pants.

In FIG. 22B, the outer shell 212 is in a second position with respect to the inner pants 214 where the outer shell 212 has moved relative to the inner pants 214 in a direction indicated by the arrows and where each first retainer $\mathbf{292}_i$ is no longer positioned at mid-length of a corresponding exposed portion $\mathbf{252}_i$ of the belt 240 and is now positioned approximately at an end portion of the corresponding exposed portion $\mathbf{252}_i$ of the belt 240.

The outer shell 212 is thus movable with respect to the inner pants 214 between first and second positions.

In order to remove the inner pants 214 from the outer shell 212, each exposed portion of the belt 240 is slipped through the opening of each retaining member such that the belt 240 is no longer received in the first retainers $\mathbf{292}_1$-$\mathbf{292}_R$ and such that the outer shell 212 is no longer coupled to the inner pants 214.

Figure 23:
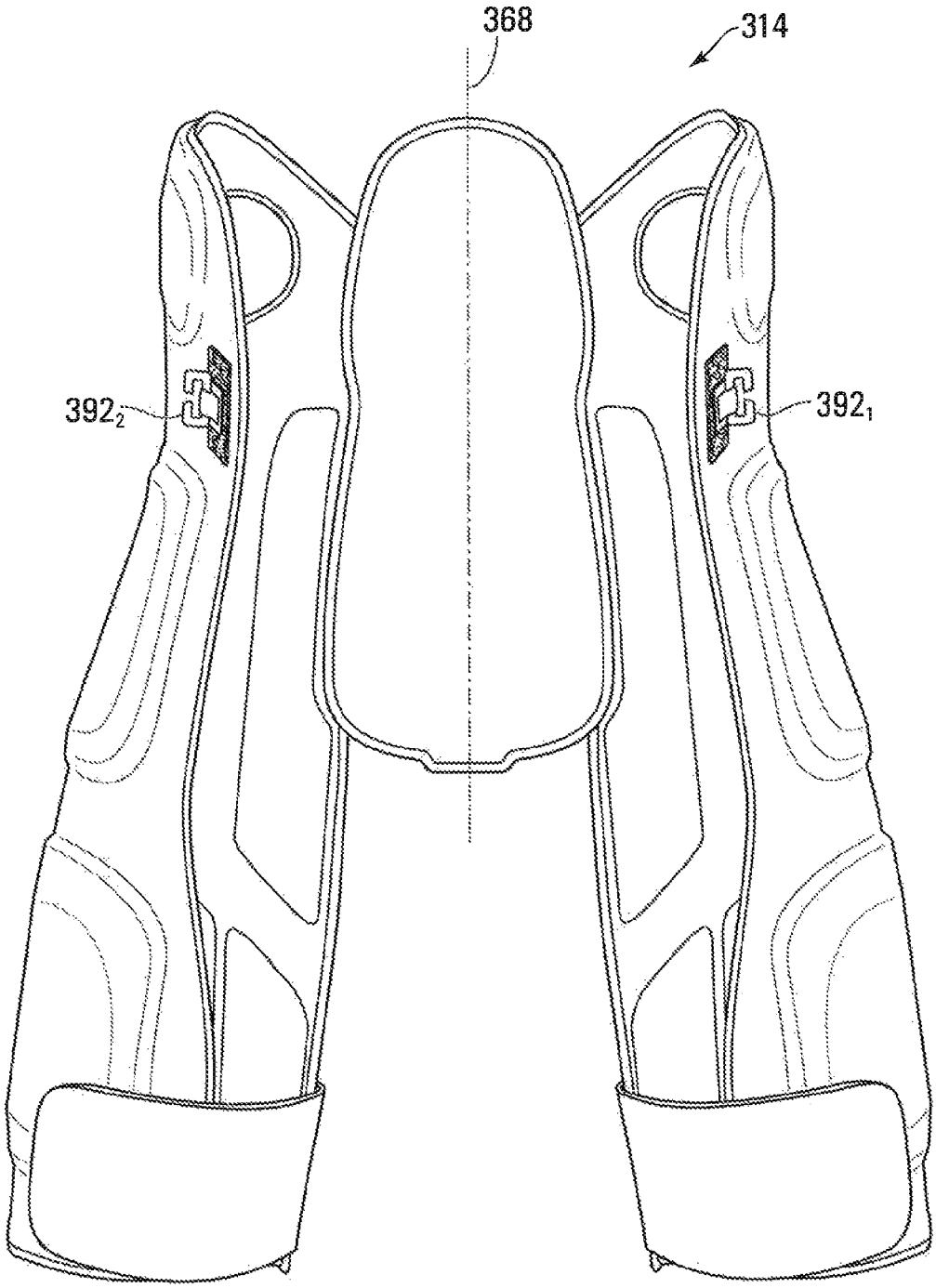
FIGS. 23 and 24 show a further embodiment in which each first retainer comprises a bottom section or backing member that is detachably affixed to the inner parts in order to allow a height of the outer shell to be adjustable relative to the inner pants.
Figure 24:
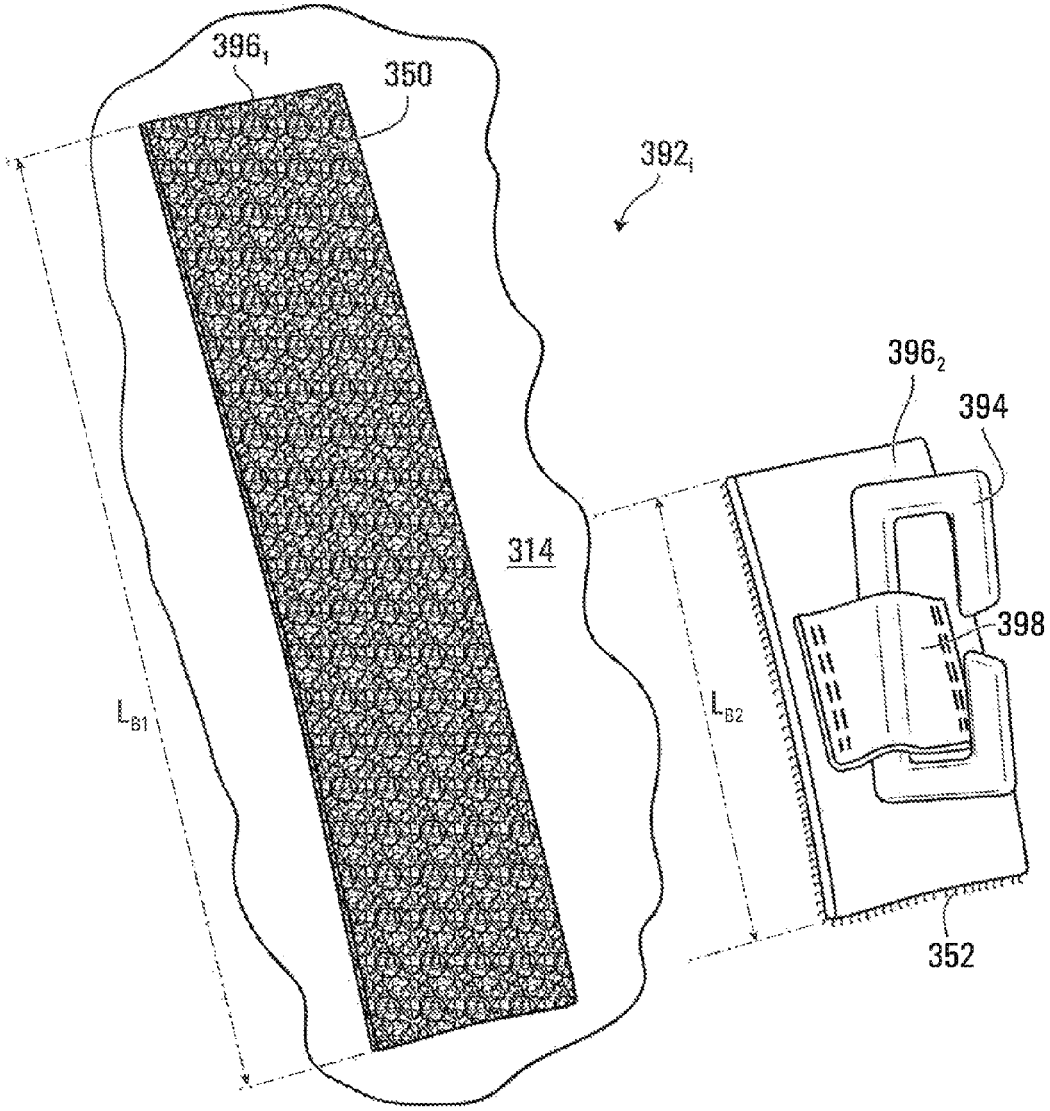

In some embodiments, the retaining system of the pants assembly may allow the player to adjust a height of the outer shell relative to the inner pants. For instance, as shown in FIGS. 23 and 24, inner pants 314 comprise a plurality of first retainers $\mathbf{392}_1$-$\mathbf{392}_R$ positioned at a waist portion of the inner pants 314. Each first retainer $\mathbf{392}_i$ of the plurality of first retainers $\mathbf{392}_1$-$\mathbf{392}_R$ comprises a retaining member 394, first and second backing members or sections $\mathbf{396}_1$, $\mathbf{396}_2$, and an attachment member 398. The retaining member 394 and the attachment member 398 are similar to the retaining member 94 and attachment member 98 described above and thus will not be further discussed here. Suffice it to say that the retaining member 394 is attached to the second backing member $\mathbf{396}_2$ via the attachment member 398.

The first backing member or section $\mathbf{396}_1$ is fixedly attached to the inner pants 314 via any suitable method (e.g., stitching) while the second backing member or section $\mathbf{396}_2$ is detachably affixed to the first backing member $\mathbf{396}_1$ via first and second fasteners 350, 352 disposed on respective ones of the first and second backing members $\mathbf{396}_1$, $\mathbf{396}_2$. In this embodiment, the first and second fasteners 350, 352 respectively comprise a hook portion and a loop portion of a hook-and-loop fastener.

As shown in FIG. 24, the first backing member $\mathbf{396}_1$ has a length $L_{B1}$ while the second backing member $\mathbf{396}_2$ has a length $L_{B2}$, the length $L_{B1}$ of the first backing member $\mathbf{396}_1$ being greater than the length $L_{B2}$ of the second backing member $\mathbf{396}_2$. For example, a ratio $L_{B1}/L_{B2}$ of the length $L_{B1}$ of the first backing member $\mathbf{396}_1$ over the length $L_{B2}$ of the second backing member $\mathbf{396}_2$ may be greater than than 1.4, in some cases greater than 1.6, in some cases greater than 1.8, in some cases greater than 2.0. The length of the first backing or section may be between one and two inches and the length of the second backing or section may be between two and four inches for allowing height adjustment along a range of about 1 inch to about two inches.

The greater extent of the length $L_{B1}$ of the first backing member $\mathbf{396}_1$ relative to the length $L_{B2}$ of the second backing member $\mathbf{396}_2$ allows a position of the retaining member 394 to be adjusted in a height direction of the inner pants 314 (i.e., in a longitudinal direction of the inner pants 314 generally defined by a longitudinal axis 368 of the inner pants 314). For instance, in one example of implementation, the length $L_{B1}$ of the first backing member $\mathbf{396}_1$ may measure two inches while the length $L_{B2}$ of the second backing member $\mathbf{396}_2$ may measure one inch. This allows a position of the second backing member $\mathbf{396}_2$ (and thus the retaining member 394) to be adjusted in the height direction of the inner pants 314 by a total of one inch such that the height of the outer shell relative to the inner pants may be adjusted along a height of about one inch with respect to the inner pants.

For instance, the retaining member 394 of the first retainer $\mathbf{392}_i$ may define a first position in the longitudinal direction of the inner pants 314. The player wishing to adjust a height of an outer shell (such as the outer shell 12 described above) relative to the inner pants 314 detaches the second backing member $\mathbf{396}_2$ (and thus the retaining member 394) from the first backing member $\mathbf{396}_1$ and reattaches it to the first backing member $\mathbf{396}_1$ at a second position in the longitudinal direction of the inner pants 314. A similar adjustment can then be carried out in the remainder of the plurality of first retainers $392_1$-$392_R$ such that the outer shell can be lowered or lifted relative to the inner pants 314.

Figure 25:
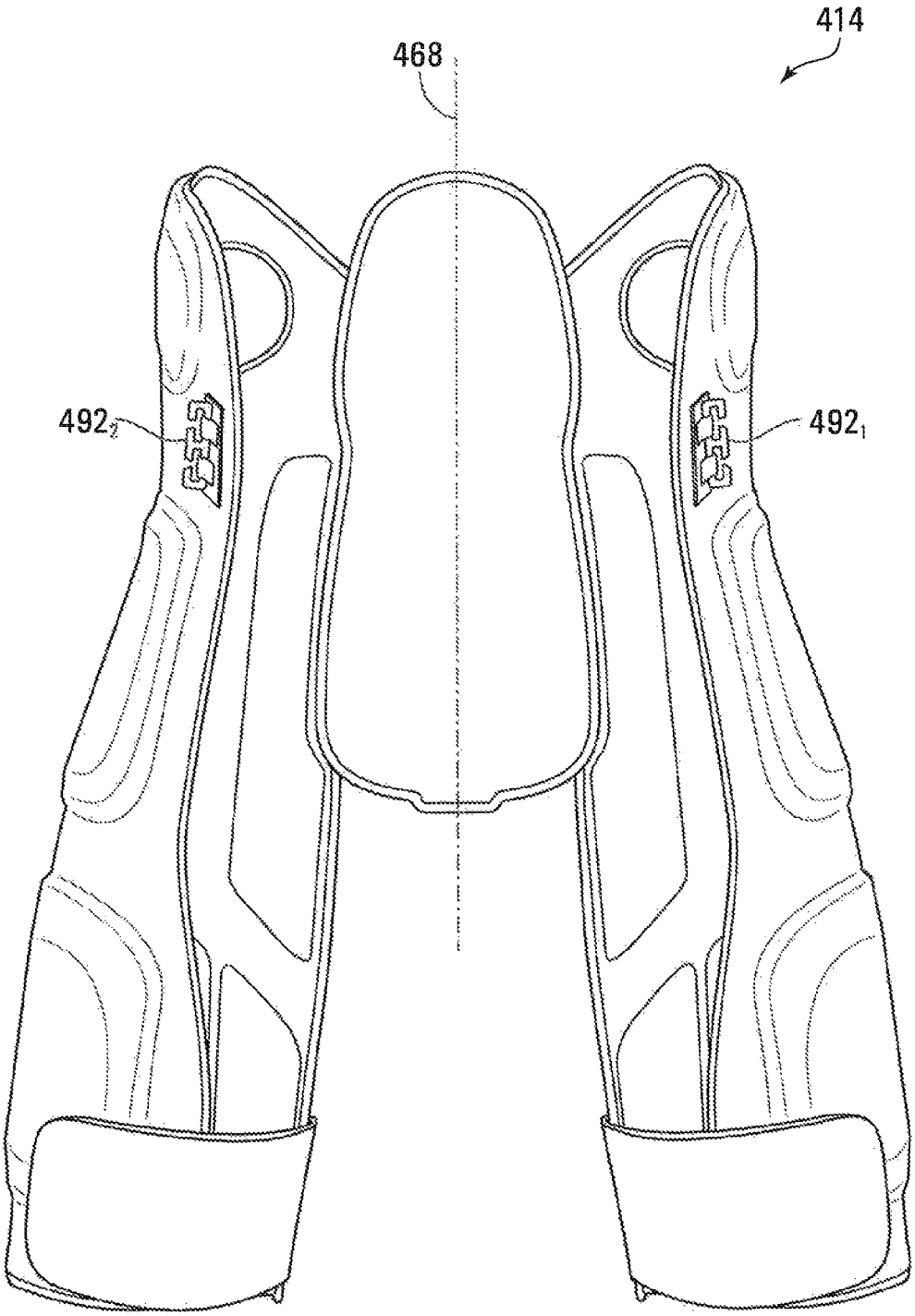
FIGS. 25 and 26 show another embodiment in which a retaining member of each first retainer comprises first and second separate openings or position adjusters to allow a height of the outer shell to be adjustable relative to the inner pants.
Figure 26:
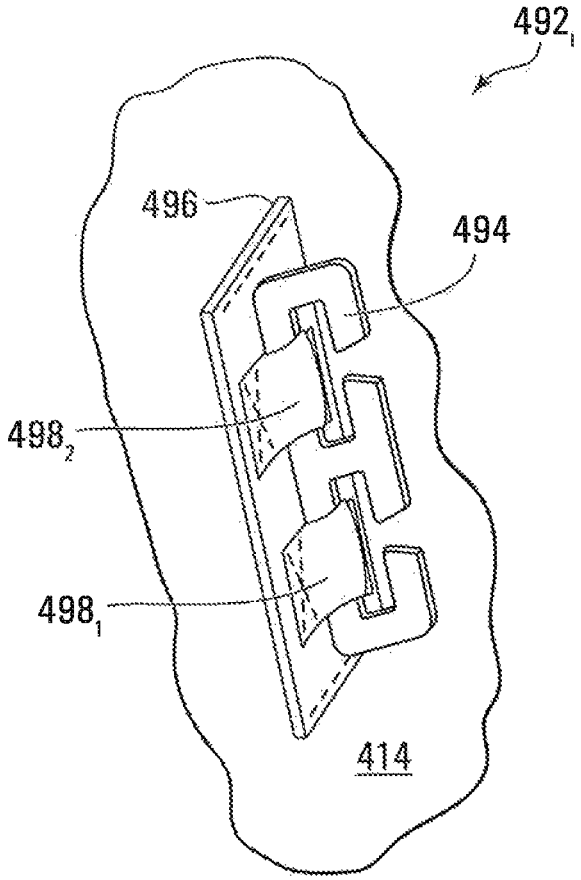

In other embodiments, the retaining member of each first retainer may be configured to allow the player to adjust a height of the outer shell relative to the inner pants. For instance, as shown in FIGS. 25 and 26, inner pants 414 comprise a plurality of first retainers $492_1$-$492_R$ positioned at a waist portion of the inner pants 414. Each first retainer $492_i$ of the plurality of first retainers $492_1$-$492_R$ comprises a retaining member 494, a backing 496, and a plurality of attachment members $498_1$, $498_2$. The retaining member 494 and the backing 496 are similar to retaining member 94 and backing 96 described above and thus will not be further discussed here.

Figure 27:
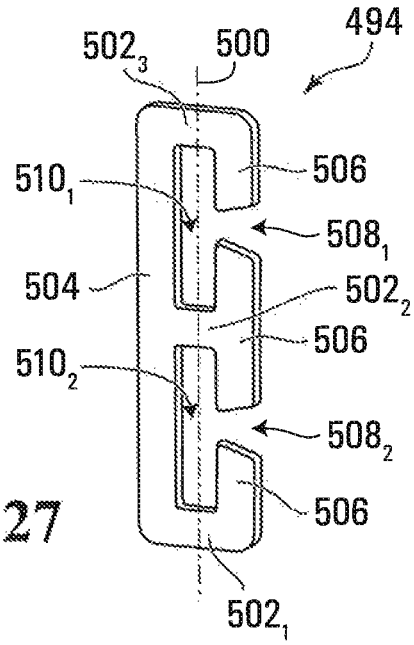
FIG. 27 shows the retaining member of the first retainer of FIGS. 25 and 26.

As shown in FIG. 27, in this embodiment, the retaining member 494 is generally E-shaped and extends along a longitudinal axis 500. The retaining member 494 comprises first, second and third transversal portions $502_1$, $502_2$, $502_3$, a continuous longitudinal portion 504, and a discontinuous longitudinal portion 506, which together form first and second position adjusters $510_1$, $510_2$. It is understood that the different portions of the retaining member 494 are "longitudinal" in that they extend in the same direction as the longitudinal axis 500 or "transversal" in that they extend in a direction transversal to the longitudinal axis 500. The discontinuous longitudinal portion 506 is "discontinuous" in that it defines first and second openings $508_1$, $508_2$ along its extent.

Each opening $508_i$ accommodates the insertion of an exposed portion $52_i$ of the belt 40 such that, when inserted into the opening $508_i$, the exposed portion $52_i$ of the belt 40 is entirely bounded by two transversal portions $502_i$, $502_j$, the continuous longitudinal portion 504, and the discontinuous longitudinal portion 506 of the retaining member 494, thus effectively being contained within a position adjuster $510_i$ of the retaining member 494.

The player wishing to adjust a height of an outer shell (such as the outer shell 12 described above) relative to the inner pants 414 can engage an exposed portion $52_i$ of the belt 40 into a given position adjuster $510_i$ of the retaining member 494 (and similarly for the retaining member 494 of each first retainer $492_i$). If the belt 40 is engaged into a lower one of the position adjusters $510_1$, $510_2$, the outer shell occupies a lower position relative to the inner pants 414 than if the belt 40 was engaged into a higher one of the position adjusters $510_1$, $510_2$. In such a manner, the outer shell can be made to occupy one of at least two distinct positions in a height direction of the inner pants 414 (i.e., in a longitudinal direction of the inner pants 414 generally defined by a longitudinal axis 468 of the inner pants 414). In one embodiment, a distance between the position adjusters $510_1$, $510_2$ may be of one inch such that the height of the outer shell relative to the inner pants may be adjusted from a first position to a second position that is one inch higher or lower.

Although in this embodiment the retaining member 494 has been described as comprising two position adjusters $510_1$, $510_2$, the retaining member 494 may comprise any number of position adjusters such that one of more than two distinct positions in the longitudinal direction of the inner pants 414 may be occupied by the outer shell relative to the inner pants 414.

Figure 28:
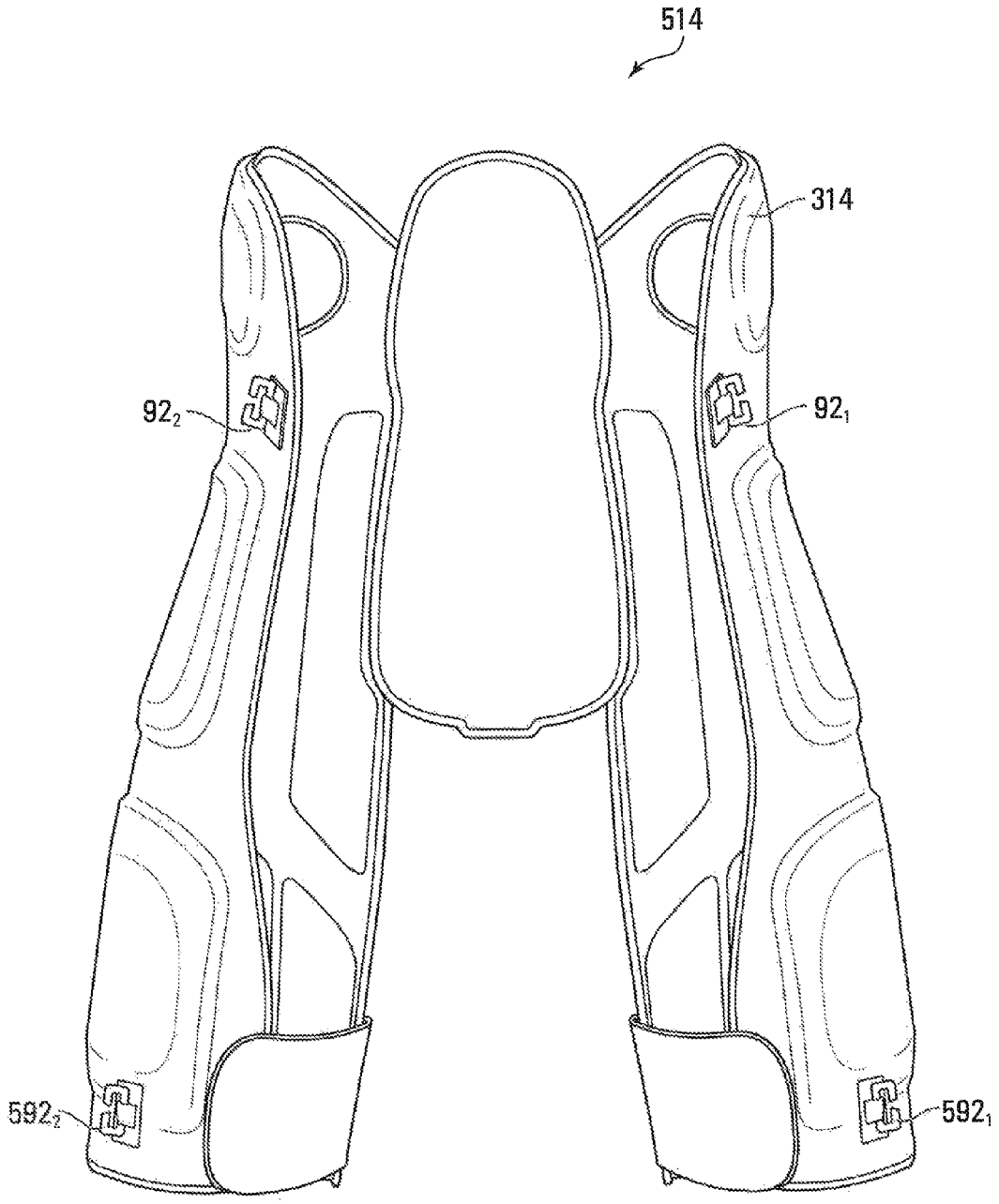
FIG. 28 shows another embodiment in which the inner pants have additional retainers affixed at the left and right lower leg portions.

In all of the variants described above, additional first retainers may be affixed at different locations of the inner pants. For instance, as shown in FIG. 28, additional to the first retainers $92_1$-$92_R$ at the waist portion, the inner pants 514 also comprises first retainers $592_1$-$592_R$ at the left and right lower leg portions. In such a case, additional to the belt at the waist portion, the outer shell also comprises second retainers such as sleeves or loops and belts at the left and right lower leg portions to interact with the first retainers $592_1$-$592_R$ at the left and right leg portions of the inner pants such that the outer shell is slidably retained to the inner pants at the lower leg portions. As described above, in a possible variant, the first retainers $592_1$-$592_R$ may instead be affixed to the outer shell. It is understood that any of the first and second retainers described above may alternatively be used.

Although this invention has been disclosed in the context of certain embodiments and examples, it is understood that other alternative embodiments, obvious modifications and equivalents are possible. In addition, while a number of embodiments have been shown and described, other modifications will be readily apparent to a skilled person based upon the present disclosure. It is also understood that various features and aspects of the disclosed embodiments can be combined with or substituted for one another in order to form other variants. Thus, various modifications and enhancements will become apparent to those of ordinary skill in the art and are within the scope of the invention, which is defined by the appended claims.

The invention claimed is:

1. A pants assembly for a wearer having a lower spine region, lower ribs, a waist, a pelvic region with left and right hips, a crotch region, a genital area, and left and right thighs, the pants assembly comprising:

(a) inner pants comprising a waist portion for covering the wearer's waist, a pelvic portion with front and rear panels for covering the wearer's pelvic region, a crotch portion for covering the wearer's crotch region and left and right leg portions for covering at least partially the left and right thighs of the wearer, the inner pants having inner and outer sides and a waist portion;

(b) an outer shell at least partially covering the inner pants, the outer shell having left and right leg sections covering the left and right leg portions of the inner pants, the outer shell having inner and outer sides and a waist portion;

(c) a belt having a first portion outside the outer shell and adjacent the outer side of the outer shell and a second portion inside the outer shell and adjacent the inner side of the outer shell and the outer side of the inner pants such that the belt at least partially encircles the waist portions of the inner pants and outer shell for allowing fit adjustment of the inner pants and outer shell around the wearer's waist; and (d) a first retainer mounted to the outer side of the inner pants and a second retainer mounted to the inner side of the outer shell, wherein the belt is received in the first and second retainers such that the inner pants and outer shell are coupled together and wherein one of the first and second retainers is slidable along the belt for allowing movement of the outer shell relative to the inner pants.

2. The pants assembly of claim 1, wherein the second retainer is a left second retainer mounted to a left portion of the inner side of the outer shell at the waist portion and wherein the pants assembly comprises a right second retainer mounted to a right portion of the inner side of the outer shell at the waist portion, the left and right second retainers being slidable along the belt.

3. The pants assembly of claim 2, wherein the pants assembly comprises a rear second retainer mounted to a rear portion of the inner side of the outer shell at the waist portion, the left, right and rear retainers being slidable along the belt.

4. The pants assembly of claim 3, wherein the left, right and rear second retainers comprise left, right and rear sleeves or loops.

5. The pants assembly of claim 1, wherein the belt is removably received in the first retainer or in the second retainer such that the outer shell is removable from the inner pants.

6. The pants assembly of claim 5, wherein the belt remains on the outer shell when the outer shell is removed from the inner pants.

7. The pants assembly of claim 6, wherein the belt second portion has first and second ends and the outer shell has first and second belt openings allowing passage of the first and second ends of the belt such that the first and second ends of the belt are located outside the outer shell and adjacent a front portion of the outer side of the outer shell.

8. The pants assembly of claim 7, wherein the pants assembly comprises first and second connectors mounted at the first and second ends of the belt for fastening the belt on the outer side of the outer shell and allowing fit adjustment of the outer shell and inner pants around the wearer's waist.

9. The pants assembly of claim 1, wherein the first retainer is detachably affixed to outer side of the inner pants to allow a height of the outer shell to be adjustable relative to the inner pants.

10. The pants assembly of claim 9, wherein the first retainer has a bottom section with hooks or loops and the outer side of the inner pants has a top section with hooks or loops for detachably affixing the first retainer to the inner pants.

11. The pants assembly of claim 10, wherein the bottom section has a length between one and two inches and the top section has a length between two and four inches for allowing height adjustment along a range of about 1 inch to about two inches.

12. The pants assembly of claim 1, wherein the first retainer has first and second separate openings, each opening allowing passage of an exposed portion of the belt from a first position to a second position where the belt exposed portion is retained in the first retainer, wherein a distance between the first and second separate openings allow a height of the outer shell to be adjustable relative to the inner pants.

13. A pants assembly for a wearer having a lower spine region, lower ribs, a waist, a pelvic region with left and right hips, a crotch region, a genital area, and left and right thighs, the pants assembly comprising:

(a) inner pants comprising a waist portion for covering the wearer's waist, a pelvic portion with front and rear panels for covering the wearer's pelvic region, a crotch portion for covering the wearer's crotch region and left and right leg portions for covering at least partially the left and right thighs of the wearer, the inner pants having inner and outer sides and a waist portion;

(b) an outer shell at least partially covering the inner pants, the outer shell having left and right leg sections covering the left and right leg portions of the inner pants, the outer shell having inner and outer sides and a waist portion;

(c) a belt having a first portion outside the outer shell and adjacent the outer side of the outer shell and a second portion inside the outer shell and adjacent the inner side of the outer shell and the outer side of the inner pants such that the belt at least partially encircles the waist portions of the inner pants and outer shell for allowing fit adjustment of the inner pants and outer shell around the wearer's waist; and (d) a left first retainer mounted to a left portion of the outer side of the inner pants at the waist portion, a right first retainer mounted to a right portion of the outer side of the inner pants at the waist portion, a left second retainer mounted to a left portion of the inner side of the outer shell at the waist portion, and a right second retainer mounted to a right portion of the inner side of the outer shell at the waist portion, wherein the belt is received in the left and right first retainers and left and right second retainers such that the inner pants and outer shell are coupled together, wherein the left and right first retainers or the left and right second retainers are slidable along the belt for allowing movement of the outer shell relative to the inner pants, and wherein the belt is removably received in the left and right first retainers or in the left and right second retainers such that the outer shell is removable from the inner pants.

14. The pants assembly of claim 13, wherein the left and right second retainers are slidable along the belt.

15. The pants assembly of claim 14, wherein the pants assembly comprises a rear second retainer mounted to a rear portion of the inner side of the outer shell at the waist portion, the left, right and rear second retainers being slidable along the belt.

16. The pants assembly of claim 15, wherein the left, right and rear second retainers comprise left, right and rear sleeves or loops.

17. The pants assembly of claim 15, wherein each of the left and right first retainers has an opening for allowing passage of an exposed portion of the belt from a first position to a second position where the belt exposed portion is retained in the first retainer.

18. The pants assembly of claim 17, wherein the belt remains on the outer shell when the outer shell is removed from the inner pants.

19. The pants assembly of claim 18, wherein the belt second portion has first and second ends and the outer shell has first and second belt openings allowing passage of the first and second ends of the belt such that the first and second ends of the belt are located outside the outer shell and adjacent a front portion of the outer side of the outer shell.

20. The pants assembly of claim 19, wherein the pants assembly comprises first and second connectors mounted at the first and second ends of the belt for fastening the belt on the outer side of the outer shell and allowing fit adjustment of the outer shell and inner pants around the wearer's waist.

21. The pants assembly of claim 17, wherein the left first retainer is a front left first retainer mounted to a front left portion of the outer side of the inner pants at the waist portion, wherein the right first retainer is a front right first retainer mounted to a front right portion of the outer side of the inner pants at the waist portion, and wherein the pants assembly comprises a rear left first retainer mounted to a rear left portion of the outer side of the inner pants at the waist portion and a rear right first retainer mounted to a rear right portion of the outer side of the inner pants at the waist portion.

22. The pants assembly of claim 13, wherein each of the first retainers is detachably affixed to outer side of the inner pants to allow a height of the outer shell to be adjustable relative to the inner pants.

23. The pants assembly of claim 22, wherein each of the first retainers has a bottom section with hooks or loops and the outer side of the inner pants has a top section with hooks or loops for detachably affixing the first retainer to the inner pants.

24. The pants assembly of claim 23, wherein the bottom section has a length between one and two inches and the top section has a length between two and four inches for allowing height adjustment along a range of about 1 inch to about two inches.

25. The pants assembly of claim 13, wherein each of the first retainers has first and second separate openings, each opening allowing passage of an exposed portion of the belt from a first position to a second position where the belt exposed portion is retained in the first retainer, wherein a distance between the first and second separate openings allow a height of the outer shell to be adjustable relative to the inner pants.

26. A pants assembly for a wearer, the pants assembly comprising:

(a) inner pants comprising a waist portion for covering a waist of the wearer, a pelvic portion with front and rear panels for covering a pelvic region of the wearer, a crotch portion for covering the a crotch region of the wearer and left and right leg portions for covering at least partially left and right thighs of the wearer;

(b) an outer shell at least partially covering the inner pants, the outer shell having left and right leg sections at least partially covering the left and right leg portions of the inner pants; and (c) a retainer mounted to one of (i) the inner pants and (ii) the outer shell, wherein the retainer supports a portion of the other one of (i) the inner pants and (ii) the outer shell in different predetermined positions to allow a height of the pants assembly to be adjusted between predetermined heights.

27. The pants assembly of claim 26, wherein the retainer is affixable to an outer side of the inner pants at different heights.

28. The pants assembly of claim 27, wherein the retainer is detachable from the outer side of the inner pants.

29. The pants assembly of claim 27, wherein the retainer has a section with hooks or loops and the outer side of the inner pants has a section with hooks or loops for detachably affixing the retainer to the inner pants.

30. The pants assembly of claim 29, wherein the sections are dimensioned to allow height adjustment of the pants assembly in a range of about 1 inch to about 2 inches.

31. The pants assembly of claim 26, wherein the retainer has first and second separate openings, each opening receiving said portion of said other one of (i) the inner pants and (ii) the outer shell, wherein the first and second separate openings are separated in height to allow the height of the pants assembly to be adjusted.

32. The pants assembly of claim 26, wherein said other one of (i) the inner pants and (ii) the outer shell comprises a portion of the outer shell adjacent an inner side of the outer shell and an outer side of the inner pants.

33. The pants assembly of claim 32, wherein the retainer has first and second openings, each opening receiving said portion of the outer shell adjacent an inner side of the outer shell and the outer side of the inner pants, wherein the first and second openings are separated in height to allow the height of the pants assembly to be adjusted.

34. The pants assembly of claim 33, the retainer being one of a plurality of retainers around the waist portion of the inner pants.

35. The pants assembly of claim 26, the retainer mounted to the inner pants and supporting a portion of the outer shell in different positions to allow a height of the pants assembly to be adjusted.

36. The pants assembly of claim 26, the retainer mounted to the outer shell and supporting a portion of the inner pants in different positions to allow a height of the pants assembly to be adjusted.

37. The pants assembly of claim 26, wherein the retainer comprises sleeves or loops.

38. The pants assembly of claim 26, wherein a belt portion is removably received in the retainer such that the outer shell is removable from the inner pants.

39. The pants assembly of claim 38, wherein the belt portion remains on the outer shell when the outer shell is removed from the inner pants.

40. A protective pant for a wearer, the protective pant comprising:

a waist portion for overlying a waist of the wearer;

a pelvic portion for overlying a pelvic region of the wearer;

a pair of leg portions for overlying left and right thighs of the wearer; and a retaining system interconnecting a first part of the protective pant and a second part of the protective pant and configured for moving the first part of the protective pant and the second part of the protective pant relative to one another to adjust a height of the protective pant, the retaining system comprising a first retaining element and a second retaining element that is selectively attachable to and detachable from the first retaining element, at least one of the first and second retaining elements being selectively attachable to and detachable from a respective part of the protective pant in different positions to adjust the height of the protective pant.

41. The protective pant of claim 40, wherein the first retaining element has a plurality of openings at different heights.

42. The protective pant of claim 40, wherein the first retaining element is an E-shaped retaining member.

43. The protective pant of claim 40, wherein the first and second retaining elements are adjacent the waist portion.

44. A pants assembly, comprising:

(a) inner pants comprising a waist portion for covering a wearer's waist and left and right leg portions for covering at least partially left and right thighs of the wearer, the inner pants having inner and outer sides and a waist portion;

(b) an outer shell at least partially covering the inner pants, the outer shell having left and right leg sections covering the left and right leg portions of the inner pants, the outer shell having inner and outer sides and a waist portion;

(c) a belt having a first portion outside the outer shell and adjacent the outer side of the outer shell and a second portion inside the outer shell and adjacent the inner side of the outer shell and the outer side of the inner pants such that the belt at least partially encircles the waist portions of the inner pants and outer shell for allowing fit adjustment of the inner pants and outer shell around the wearer's waist; and (d) a retainer mounted to one of (i) the inner pants and (ii) the outer shell, wherein the retainer supports a portion of the other one of (i) the inner pants and (ii) the outer shell in different positions to allow a height of the pants assembly to be adjusted.

* * * * *